US005903092A

United States Patent [19]

Akama

[11] Patent Number: 5,903,092

[45] Date of Patent: May 11, 1999

[54] DEVICE FOR EMITTING ELECTRONS

[75] Inventor: Yoshiaki Akama, Yokohama, Japan

[73] Assignee: Kabushiki Kaisha Toshiba, Kawasaki, Japan

[21] Appl. No.: 08/443,320

[22] Filed: May 17, 1995

[30] Foreign Application Priority Data

| | | | |
|---|---|---|---|
| May 18, 1994 | [JP] | Japan | 6-103881 |
| Mar. 24, 1995 | [JP] | Japan | 7-066080 |
| Mar. 24, 1995 | [JP] | Japan | 7-066190 |
| Apr. 28, 1995 | [JP] | Japan | 7-127576 |

[51] Int. Cl.[6] ..... H01J 1/00

[52] U.S. Cl. ..... 313/311; 313/310; 313/309; 313/336; 313/351

[58] Field of Search ..... 313/310, 309, 313/311, 306, 336, 351; 257/13–27, 94, 95–97, 192

[56] References Cited

U.S. PATENT DOCUMENTS

| | | | |
|---|---|---|---|
| 3,466,485 | 9/1969 | Arthur, Jr. et al. | 313/351 X |
| 3,671,798 | 6/1972 | Lees | 313/336 |
| 3,720,856 | 3/1973 | Brody | 313/351 X |
| 3,755,704 | 8/1973 | Spindt et al. | 313/309 |
| 3,789,471 | 2/1974 | Spindt et al. | 313/309 X |
| 4,163,949 | 8/1979 | Shelton | 313/351 X |
| 4,345,181 | 8/1982 | Shelton | 313/336 X |
| 4,578,614 | 3/1986 | Gray et al. | 313/311 X |
| 5,066,883 | 11/1991 | Yoshioka et al. | 313/309 |
| 5,362,972 | 11/1994 | Yazawa et al. | 257/13 |

FOREIGN PATENT DOCUMENTS

| | | |
|---|---|---|
| 0 452 950 | 10/1991 | European Pat. Off. . |
| 4-355027 | 12/1992 | Japan . |
| 5-41152 | 2/1993 | Japan . |
| 5-94762 | 4/1993 | Japan . |
| 5-234500 | 9/1993 | Japan . |
| 6-203741 | 7/1994 | Japan . |

OTHER PUBLICATIONS

Patent Abstracts of Japan, vol. 18, No. 551 (E–1619), Oct. 20, 1994, JP–A–6 203748, Jul. 22, 1994.

Patent Abstracts of Japan, vol. 18, No. 551 (E–1619), Oct. 20, 1994, JP–A–6 203747, Jul. 22, 1994.

Patent Abstracts of Japan, vol. 16, No. 233 (E–1209), May 28, 1992, JP–A–4 045560, Feb. 14, 1992.

J. IEE Japan, vol. 112, No. 4 (1992), pp. 257–262 by Kuniyoshi Yokoh in Electrical Communication Laboratory of Tohoku University.

"Application of Small Cold Cathode—Vacuum Microelectric Device" Optronics No. 109 (1991), pp. 193–198 by Junji Itoh and Seigo Kanemaru.

"Industrial Application of Charged Particle Beam" Junji Itoh and Seigo Kanemaru, 111th Laboratory Material for 132nd Committee of Japan Society for the Promotion of Science (1990), pp. 7–13.

"Flat Display Based on the Metal–Insulator–Metal Emitter Array" J.Vac.Sci.Technol. B 11(2), pp. 514–517, P.E. Troyan, et al., Mar./Apr. 1993.

*Primary Examiner*—Ashok Patel

*Attorney, Agent, or Firm*—Oblon, Spivak, McClelland, Maier & Neustadt, P.C.

[57] ABSTRACT

A device comprising a conductor and an emitter electrode for emitting electrons formed on the conductor, the emitter electrode including a mass of a plurality of columnar crystals each containing β-tungsten and having a sharpened tip end portion for emitting electrons, the plurality of columnar crystals being put in contact with one another.

38 Claims, 36 Drawing Sheets

$SiH_4/WF_6=0.6$ $SiH_4/WF_6=0.8$ $SiH_4/WF_6$=0.9

$SiH_4/WF_6$=1.0

$SiH_4/WF_6 = 2.0$

T=240°C ($WF_6$:$SiH_4$:$H_2$=1:25)

T=320°C ($WF_6$:$SiH_4$:$H_2$=1:1:25)

T=400°C ($WF_6$:$SiH_4$:$H_2$=1:1:25)

$H_2$=0sccm (T=320°C, $WF_6$:$SiH_4$:$H_2$=1:1:0)

$H_2$=100sccm (T=320°C, $WF_6$:$SiH_4$:$H_2$=1:1:10)

$H_2$=250sccm (T=320°C,
$WF_6$:$SiH_4$:$H_2$=1:1:25)

$H_2$=500sccm (T=320°C,
$WF_6$:$SiH_4$:$H_2$=1:1:50)

$H_2$=750sccm (T=320°C,
WF6:$SiH_4$:$H_2$=1:1:75)

$H_2$=1000sccm (T=320°C,
WF6:$SiH_4$:$H_2$=1:1:100)

(CVD)

(THERMAL OXIDATION)

(CVD)

(THERMAL OXIDATION)

DEVICE FOR EMITTING ELECTRONS

BACKGROUND OF THE INVENTION

1. Field of the Invention

The present invention relates to a microelectronic device for emitting electrons by using a vacuum microelectronic technique, and a method of manufacturing the same.

2. Description of the Related Art

With recent advancement in semiconductor micropatterning techniques, micron-order vacuum tubes have been developed. The purpose of this development is to reconsider a vacuum as an electron transportation medium, thereby developing an ultra-high-speed, environment-resistant, electron emitting device which overcomes the drawbacks of vacuum tubes replaced by solid-state devices.

Typical electron emitting devices now being developed are of a Spindt type (Gray type), a plane type, and an MIM (Metal-Insulator-Metal).

In a Spindt type electron emitting device, as shown in FIG. 45, an emitter electrode 1 extends substantially vertically from a substrate 2 in the form of a quadrangular prism or a cone. In a plane type electron emitting device, as shown in FIGS. 46A and 46B, an emitter electrode 3 extends in a direction parallel to a substrate 2 in the form of a triangular diving platform, i.e. a wedge. In FIGS. 45, 46A and 46B, reference numerals 4 and 5 denote gate electrodes for extracting electrons from the emitter electrodes 1 and 3.

Specifically, the Spindt type and plane type electron emitting devices have emitter electrodes 1 and 3 with sharpened tip portions. An electric field is applied to the emitter electrode 1, 3 from the adjacent gate electrode 4, 5, thereby extracting (discharging) electrons from the emitter electrode 1, 3.

As disclosed in, for example, J. EE Japan, Vol. 112, No. 4 (1992), pp. 257–262 by Kuniyoshi Yokoh in the Electrical Communication Laboratory of Tohoku University, a Spindt type electron emitting device may be manufactured by a technique of obliquely depositing a cathode chip while rotating a substrate, which technique was developed by C. A. Spindt et al. in Stanford Laboratory, or by a technique of performing selective anisotropic etching of an Si single crystal, which technique was developed by H. P. Gray et al. in the U.S. Navy Laboratory.

Methods of manufacturing other types of emitter electrodes of the plane type device, etc. are explained, for example, in "Application of Small Cold Cathode—Vacuum Microelectronic Device—" (OPTRONICS, No. 109 (1991), pp. 193–198) and "Experimental Manufacture and Application of Small-Sized Triode Vacuum Tube" (the 11th Laboratory Reference for 132nd Comittee of Japan Society for the Promotion of Science (1990), pp. 7–13 for "Industrial Application of Charged") by Junji Itoh and Seigo Kanemaru of Kogyo Gijutsuin Denshigijutsu Sogo Kenkyujo (the Electronics Research Center of the Agency of Industrial Science and Technology).

On the other hand, in an MIM type electron emitting device, although not shown, a thin insulating film and a thin conductor film are laminated on a surface of a conductor which will become an emitter electrode. An intense electric field is applied to the surface of the emitter electrode from the conductor film, thereby extracting electrons with use of quantum-mechanical tunneling phenomenon.

Whether the development of such a device is significant depends on how much the operating voltage of the device can be decreased. In order to decrease the operating voltage, it is necessary to enhance the electron emission efficiency (emission current density) of the emitter electrode of the electron emitting device.

There is an idea that the electron emitting device is applicable to an electron emission source of an electron beam plotter or a planar display. For this purpose, it is desirable to emit electrons at high density in a planar manner.

In the Spindt type and plane type devices, the emitter electrode is formed in a pyramidal or conical shape (Spindt type) or in a wedge shape (plane type). Thereby, a tip portion of the emitter electrode is sharpened and the electron emission efficiency is enhanced.

However, since the emitter electrode 1 and 3 of the conventional electron emitting device has a pyramidal, conical or wedge-like shape, as mentioned above, the interval of field electron emission devices is limited by the size of the bottom surface of the emitter electrode 1 and 3. Thus, it is difficult to increase the density of electron emitting devices. Since the density of electrons emitted from the electron emitting device (i.e. magnitude of emission current) is influenced by the number of emitter electrodes 1 and 3, it is also difficult to increase the emission current per unit area.

In order to obtain a higher emission current with a lower drive voltage in the electron emitting device, it is necessary to sharpen the tip portion of the emitter electrode as much as possible, thereby increasing the degree of concentration of electric field.

In the case of conventional electron emitting devices, however, the emitter electrode is sharpened by etching or superposition exposure. Thus, a complex process is needed to sharpen the emitter electrode, and it is difficult to sharpen the emitter electrode. Furthermore, since the process for manufacturing the emitter electrode is complex, the reproducibility is low and it is difficult to uniformly produce a great number of emitter electrodes.

Besides, the degree of sharpness of the emitter electrode depends on the resolution of an exposure apparatus to be employed.

Specifically, the precision of the shape of the tip of the emitter electrode depends on, for example, the resolution of a stepper for performing mask patterning. Since the resolution of the apparatus is limited, the attainable degree of sharpness of the emitter electrode and the degree of density of electrodes are limited to a certain level.

On the other hand, with respect to the MIM type electron discharge device, there is no need to sharpen the electrode. In the above-described Spindt type device, electrons cannot be emitted in a planar fashion unless the emitter electrodes are formed at high density. In the MIM type device, however, electrons (or an electron beam) can be emitted in a planar fashion, irrespective of the density of the formation of electrodes. Since there is no need to sharpen the emitter electrode, the production of the emitter electrode is very easy and the yield of electrodes is high.

However, in order to enhance the electron emission efficiency of MIM type electron emitting devices, it is necessary to decrease the thickness of the insulating film as much as possible and to decrease the distance (gap) between the surface of the emitter electrode and the conductor film.

When the thickness of the insulating film cannot be thinned, the electron emission efficiency deteriorates and it is necessary to produce a high potential difference between the conductor film and the emitter electrode. As a result, the operating voltage increases.

In order to avoid such inconvenience, the thickness of the insulating film must be decreased to, e.g. 100 Å. However, it is very difficult to form the insulating film with such a thickness, since no lattice defect is permitted to be present in the insulating film.

SUMMARY OF THE INVENTION

The present invention has been made in consideration of the above circumstances, and an object of the invention is to provide an electron emitting device with high electron emission efficiency, wherein emitter electrodes can be easily sharpened and the emitter electrodes are arranged at high density, and a planar display apparatus to which this electron emitting device is applied.

Another object of the invention is to provide a field electron emitting apparatus in which the advantage of an MIM type device can be fully exhibited, the electron emission efficiency can be enhanced, and the operating voltage can be decreased.

According to the invention of present application, there is provided a device comprising a conductor and an emitter electrode for emitting electrons formed on the conductor, the emitter electrode including a mass of a plurality of columnar crystals each having a tip end portion for emitting electrons.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

First to twenty-first embodiments of the present invention will be described with reference to the accompanying FIGS. 1 to 44.

The first embodiment of the invention will now be described with reference to FIGS. 1 to 8.

Figure 1:
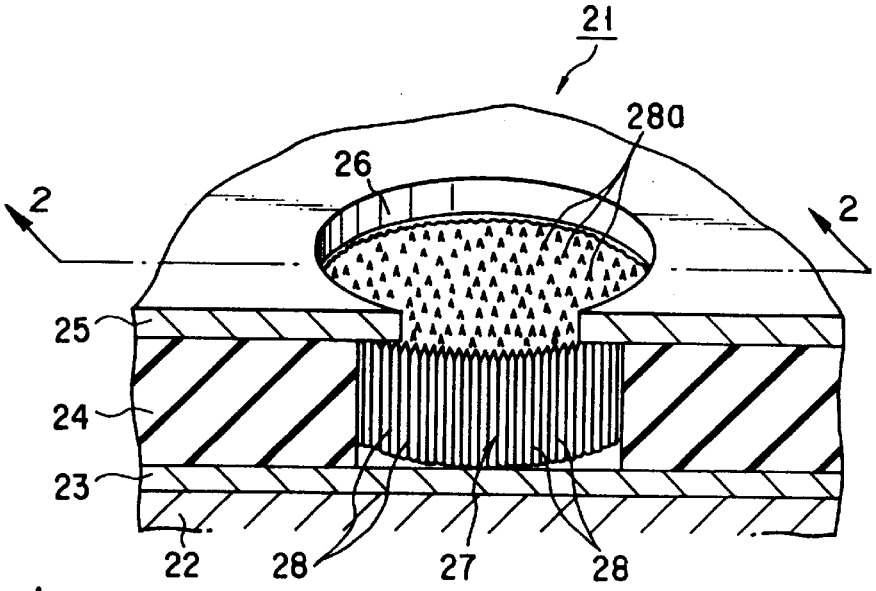
FIG. 1 is a partly broken perspective view showing an electron emitting device according to a first embodiment of the present invention.

FIG. 1 is a perspective view of an electron emitting device 21 according to the first embodiment.

Figure 2:
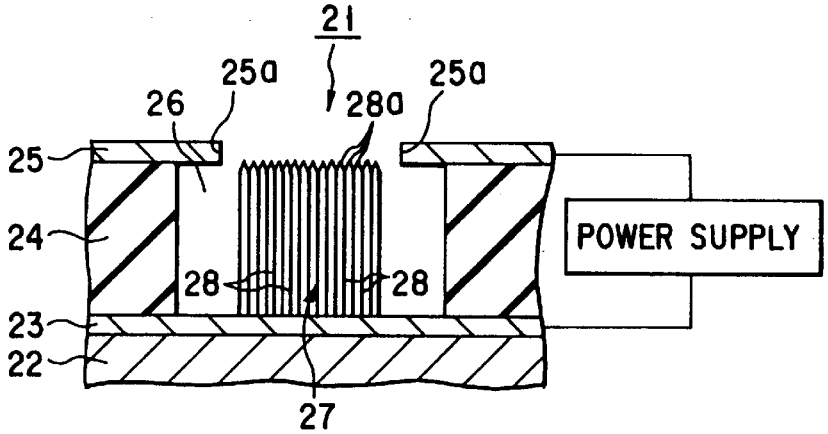
FIG. 2 is a vertical cross-sectional view taken along line 2—2 in FIG. 1.

FIG. 2 is a longitudinal sectional view taken along a line 2—2 of the device 21 in FIG. 1.

In FIG. 1, a thin-film base electrode 23 (a conductor) is formed on a substrate 22. An insulating film 24 and a conductive film 25 are successively laminated on the surface of the base electrode 23.

A cylindrical through-hole 26, which is open at the top and closed at the bottom by the base electrode 23, is formed in the insulating film 24 and conductor film 25. An edge portion 25*a* of the conductor film 25 extends into the through-hole 26 in the radially inward direction of the through-hole 26, and constitutes a gate electrode.

An electrically conductive columnar crystal mass 27 is formed on that surface portion of the base electrode 23, which is exposed to the bottom region of the through-hole 26. The columnar crystal mass 27 consists of many columnar crystals 28 functioning as an emitter electrode.

Figure 5A:
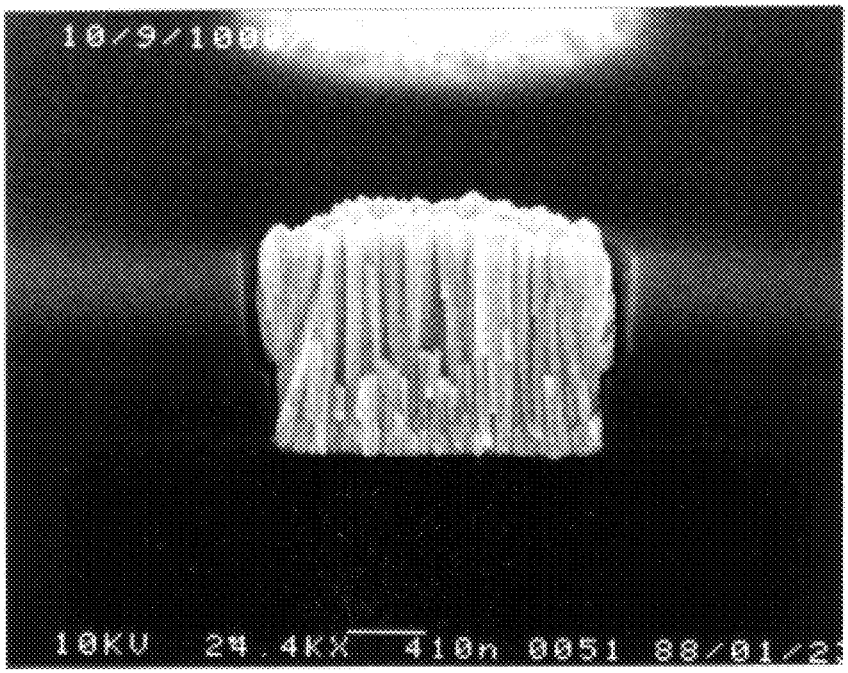
FIGS. 5A and 5B are photographs taken by an SEM (Scanning Tunneling Microscope) showing enlarged images of masses of columnar crystals.

The columnar crystal mass 27 is formed vertically up to a level short of the conductive film 25. An upper end portion 28*a* of each columnar crystal 28 is sharpened like a needle. FIG. 5A is an SEM photograph of the columnar crystal mass 27.

The columnar crystal mass 27 having the above shape is formed, for example, by CVD (Chemical Vapor Deposition) under specified conditions, as described later. Each columnar crystal 28 contains, for example, a β-W (β-phase tungsten).

It is necessary that the columnar crystal mass 27 be out of contact with the conductive film 25 (gate electrode). The crystal mass 27 may be formed up to a level higher than the conductive film 25, if the crystal mass 27 is not put in contact with the conductor film 25.

The operation of the electron emitting device 21 will now be described.

The columnar crystal mass 27 (emitter electrode) is electrically connected to the base electrode 23.

For example, if a negative voltage is applied to the base electrode 23 and a positive voltage is applied to the conductor film 25, thereby causing a potential difference between the columnar crystal mass 27 and the edge portion 25*a* of conductor film 25, an electric field is applied from the edge portion 25*a* of conductor film 25 to the crystal mass 27 via a gap therebetween.

Figure 3:
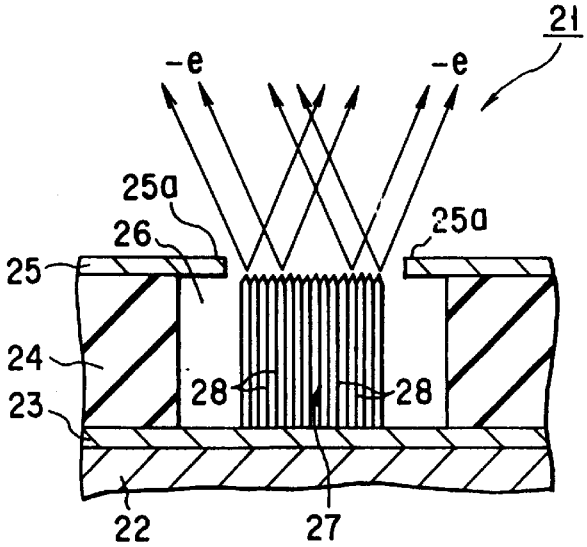
FIG. 3 is a vertical cross-sectional view illustrating the operation of the electron emitting device according to the first embodiment.

The applied electric field is concentrated at a needle-like upper end portion 28*a* of each columnar crystal 28 and, as is shown in FIG. 3, electrons (−e) are emitted from the upper end portion 28*a* of each columnar crystal 28. As described above, the columnar crystal 28 (columnar crystal mass 27) functions as emitter electrode, and the conductor film 25 functions as gate electrode for extracting electrons from the emitter electrode. Since electrons are emitted from many columnar crystals 28, as mentioned above, the electron emitting device functions as a planar electron beam emitting source.

A method for manufacturing the electron emitting device 21 will now be described with reference to FIGS. 4A to 4E.

Figure 4A:
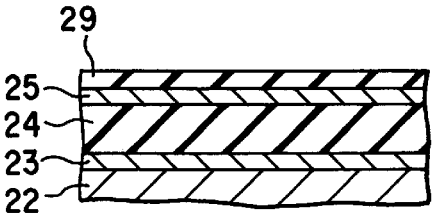
FIGS. 4A to 4E show the steps of a process for manufacturing the electron emitting device according to the first embodiment.

At first, as shown in FIG. 4A, a base electrode 23, an insulating film 24, a conductive film 25 and an insulating film 29 are formed successively on a substrate 22. The substrate 22 is, e.g. Si (silicon wafer), glass, etc. The insulating film 24 is, e.g. $SiO_2$. The base electrode 23 and conductor film 25 are formed of a generally available, electrically conductive metal such as Cu or Al. The uppermost conductor film 29 functions as a mask at the time of performing CVD (described later) and is formed of, e.g. $SiO_2$.

Figure 4B:
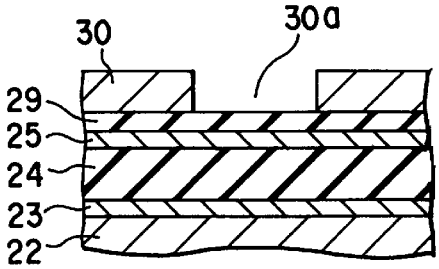

Subsequently, as shown in FIG. 4B, a resist 30 is coated on the uppermost insulating film 29 and is patterned. A pattern 30*a* of the resist 30 has a circular hole corresponding to the through-hole 26.

Figure 4C:
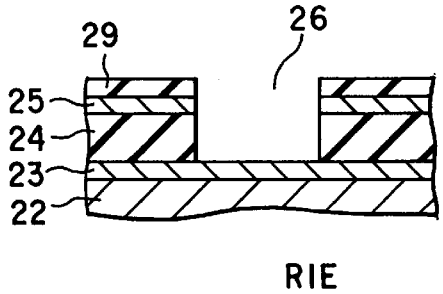

Anisotropic etching, for example, RIE (Reactive Ion Etching), is then performed. Thus, the insulating film 29, conductor film 25 and insulating film 24 are etched in accordance with the shape of the resist, as shown in FIG. 4C. As a result, the through-hole 26 is formed. The through-hole 26 reaches the base electrode 23 and the base electrode 23 is exposed at the bottom of the through-hole 26.

Following the above, the columnar crystal mass 27 is formed on the surface of the base electrode 23.

The crystal mass 27 is formed by using, for example, CVD (Chemical Vapor Deposition). Specifically, the substrate 22 is held in a reduced-pressure chamber, and the ambient temperature within the chamber is set at 120° C. to 500° C., preferably at 320° C.

Then, two reaction gases, $WF_6$ (tungsten hexafluoride) and $SiH_4$ (silane) are introduced into the chamber and are reacted. The ratio between the two reaction gases is desirably 1:1.

A tungsten (W) film is formed on that surface portion of the base electrode 23, which is located within the through-hole 26. It is estimated that each of tungsten crystals formed in the above atmosphere contains β-W (β-state tungsten). It was confirmed by experiments that the tungsten crystal grew from the surface of the base electrode 23 as a substantially vertical columnar crystal. The upper end portion 28*a* of each columnar crystal 28 is sharpened in a needle-like shape.

FIGS. 6A to 8F are SEM photographs showing the relationship between the flow ratio of the reaction gases and the ambient conditions, on the one hand, and the shape of the columnar crystal mass 27, on the other hand. The experiments relating to this were conducted at 320° C. (ambient temperature).

Figure 6A:
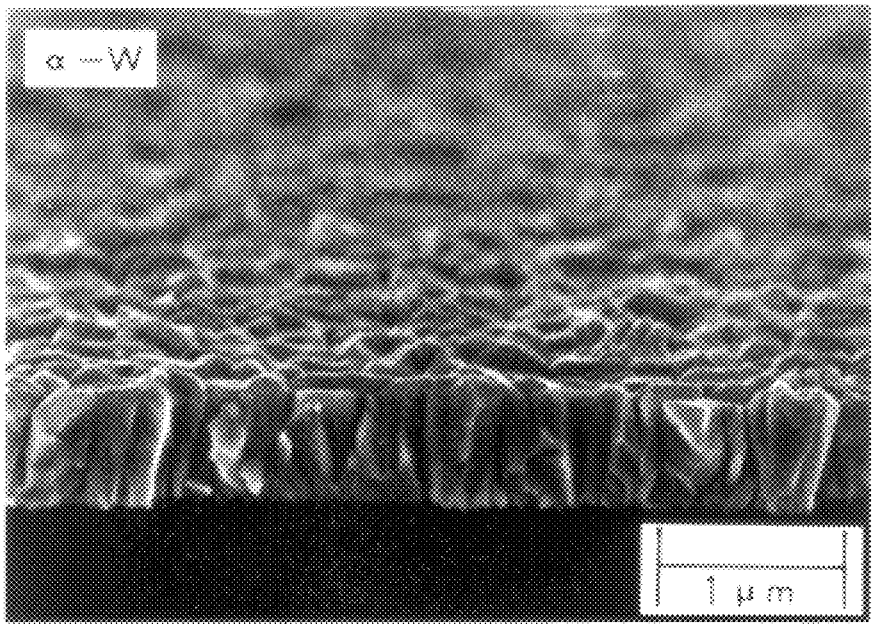
FIGS. 6A to 6E are photographs taken by the SEM showing enlarged images of crystalline structures of masses of columnar crystals.
Figure 6B:
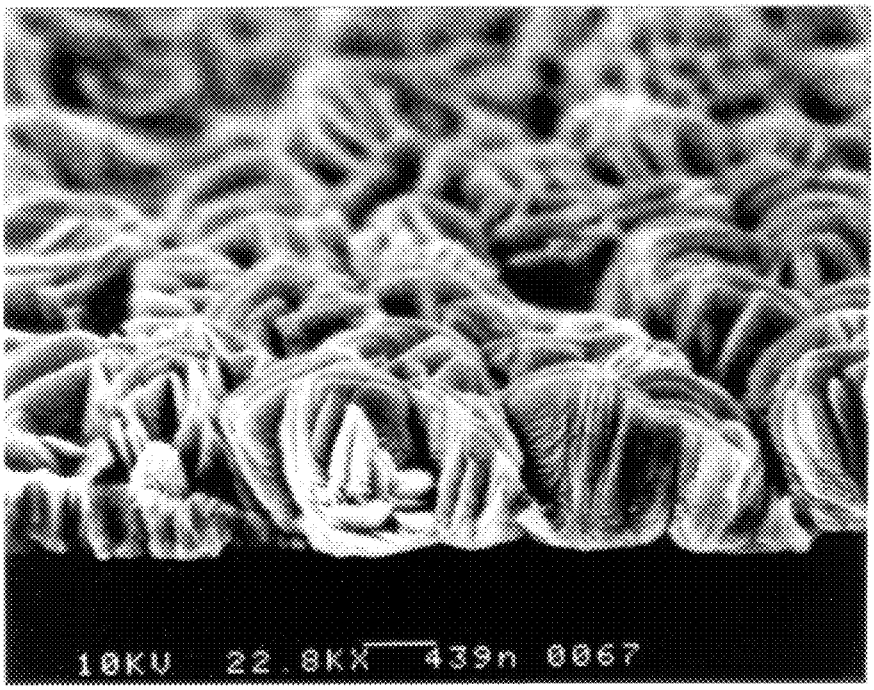
Figure 6C:
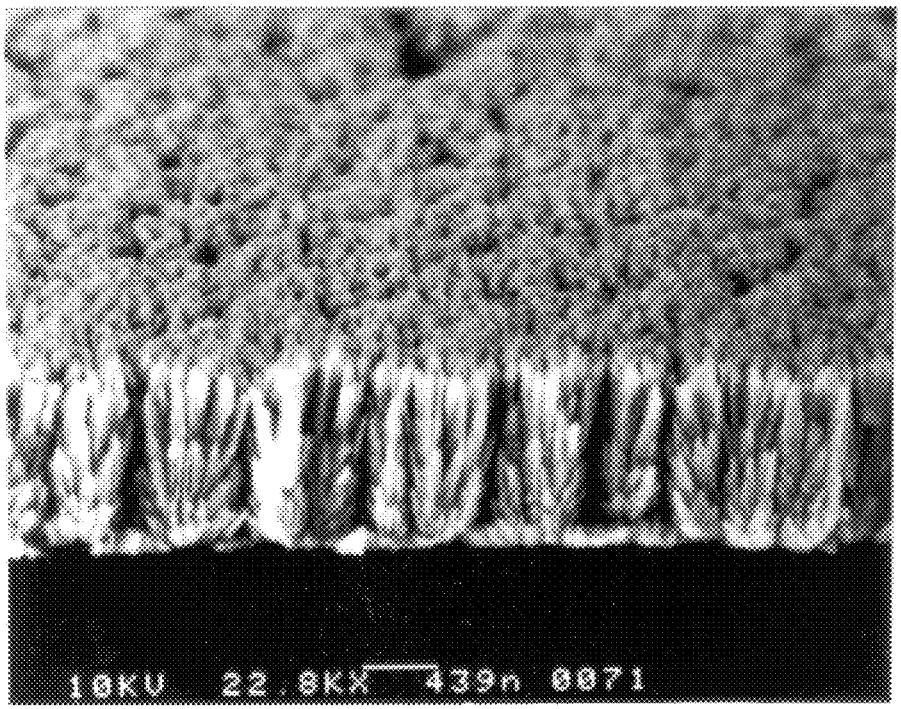
Figure 6D:
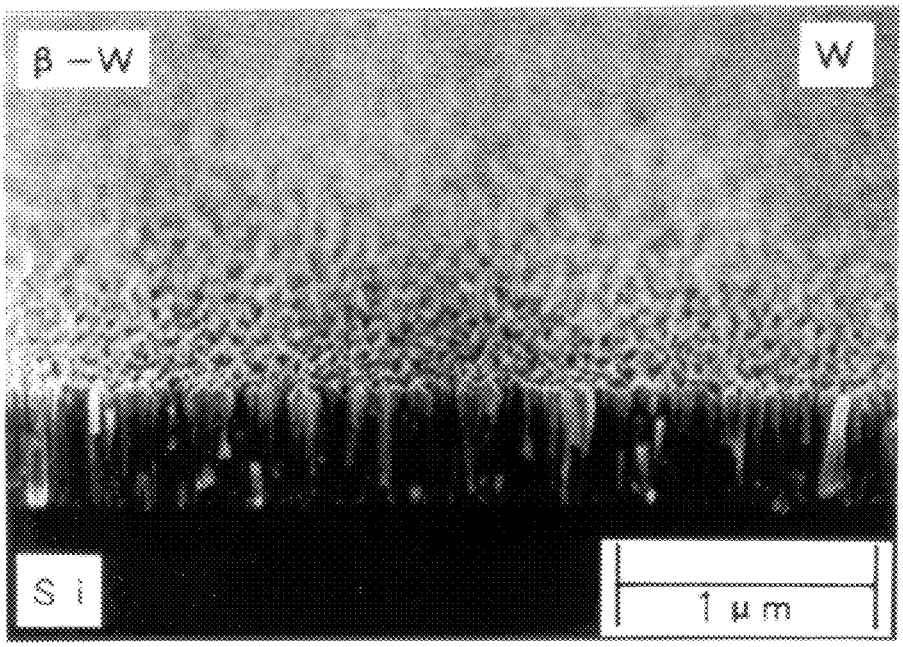
Figure 6E:
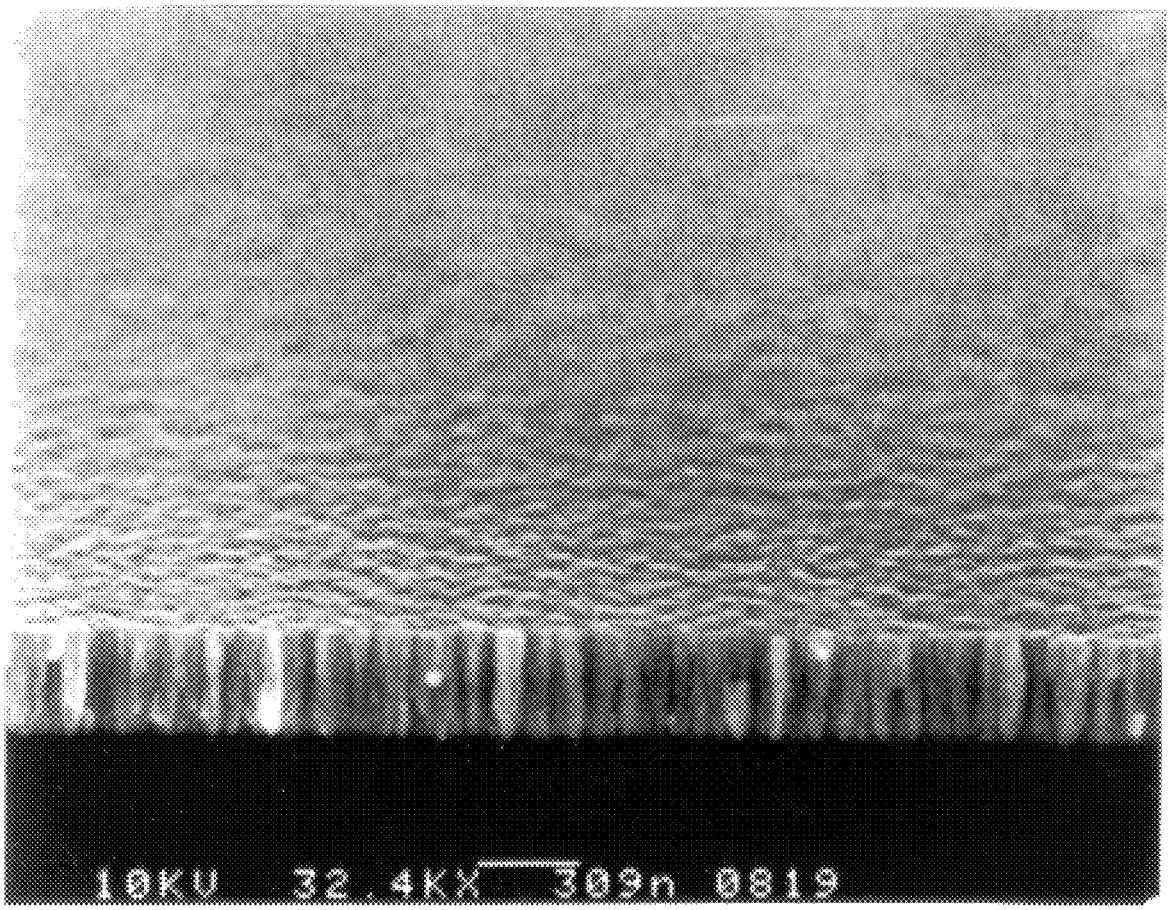

It was found that when the flow ratio ($SiH_4/WF_6$) of the two reaction gases was varied in the range of 0.6 to 2.0, the columnar crystal mass began to grow at the flow ratio of 0.9 (FIG. 6C) or more and a desirable shape of the crystal mass was obtained at 1.0 (FIG. 6D). When the flow ratio was increased to 2.0 (FIG. 6E), the upper end portion of the columnar crystal began to lose the sharpness. Thus, the flow ratio of the reaction gases under the above ambient conditions is desirably $SiH_4/WF_6$=0.9 to 2.0 and more desirably $SiH_4/WF_6$=1.0.

Figure 7A:
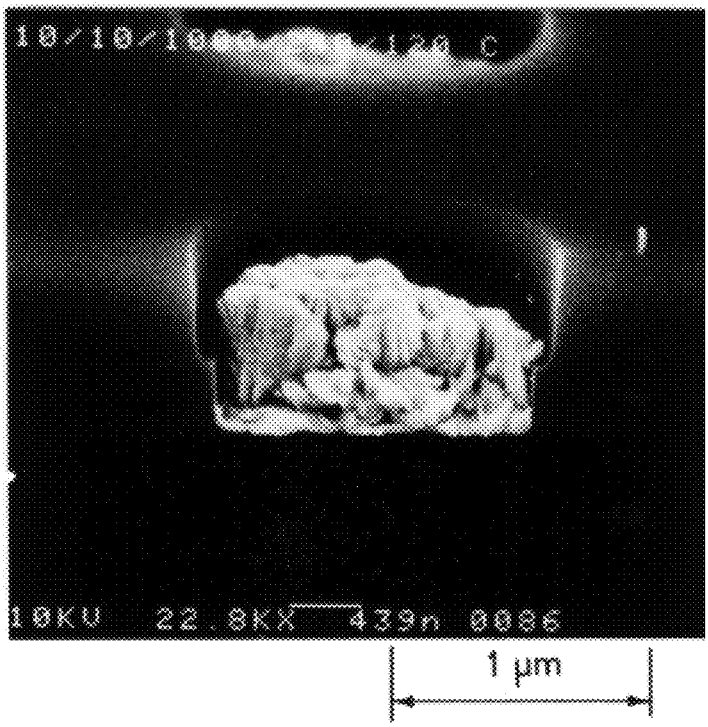
FIGS. 7A to 7C are photographs taken by the SEM showing enlarged images of crystalline structures of masses of columnar crystals.
Figure 7B:
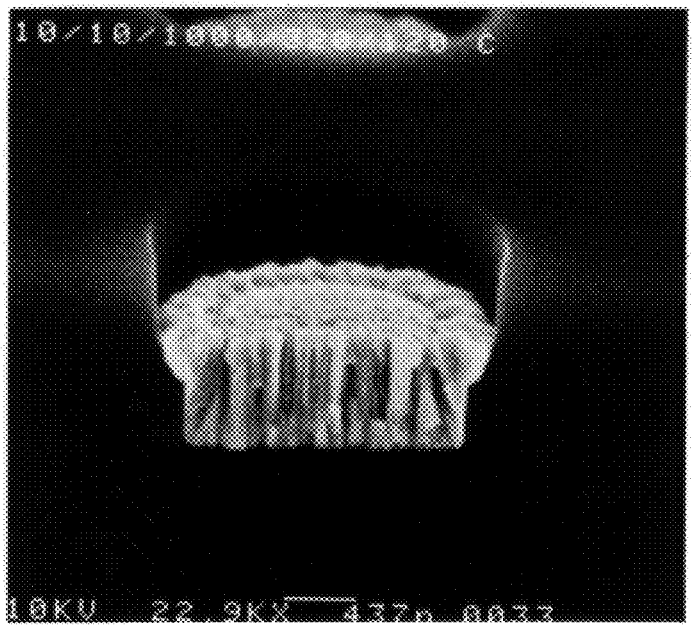
Figure 7C:
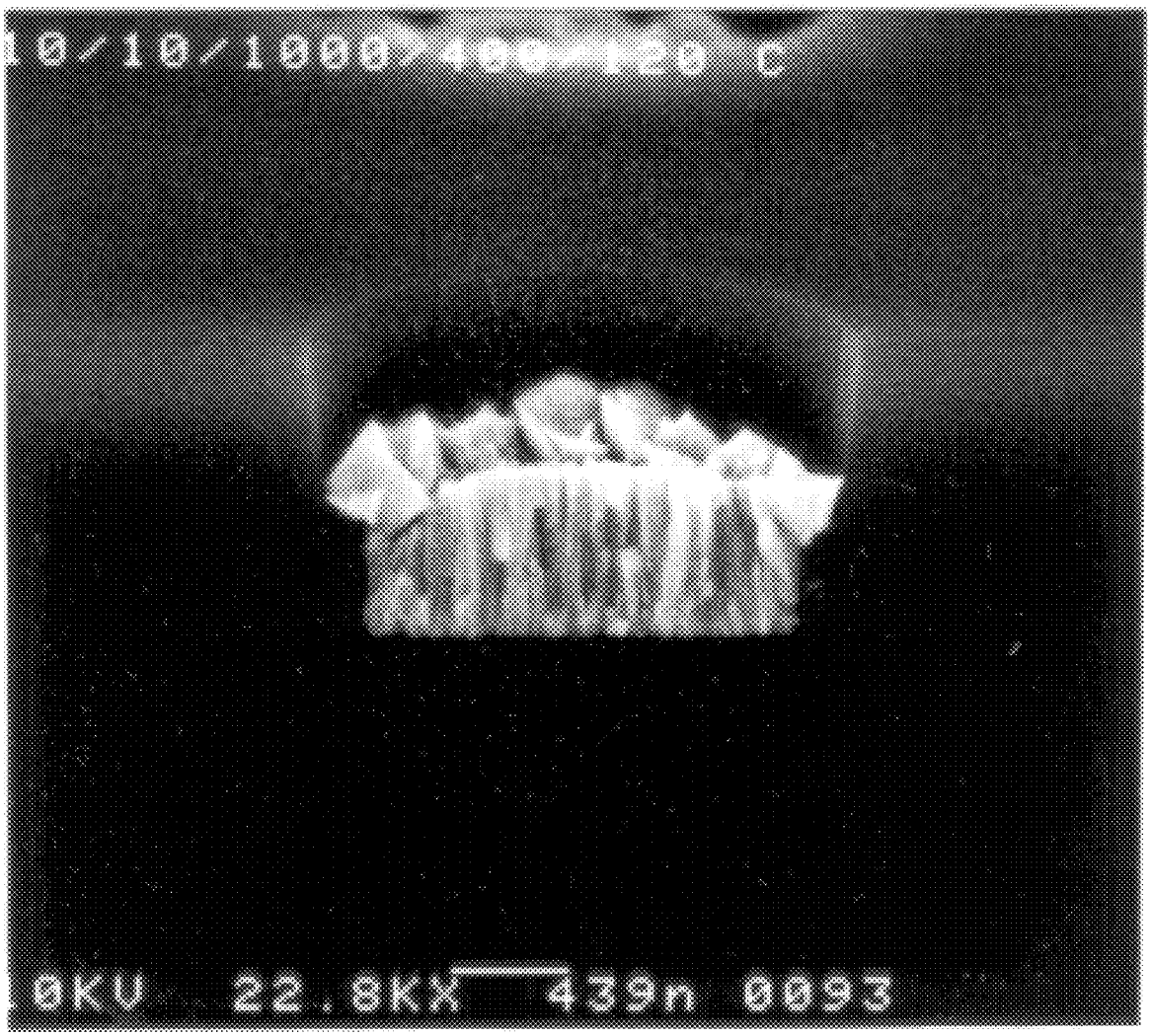

FIGS. 7A to 7C show the relationship between the ambient temperature and the shape of the columnar crystal mass. The experiments relating to this were conducted with the flow ratio of reaction gases being $SiH_4/WF_6$=1.0.

The columnar crystal mass 27 was also produced at T=240° C. (FIG. 7A) and T=400° C. (FIG. 7C), but it is understood that the desirable temperature is T=320° C. (FIG. 7B).

Furthermore, the CVD is performed, while introducing into the chamber hydrogen gas ($H_2$) for pressure control. The shape of the columnar crystal mass is greatly influenced by the flow rate of the hydrogen gas, as is understood from the experimental results shown in FIGS. 8A to 8F.

The experiments were conducted under the conditions: the ambient temperature 320° C.; the flow ratio of reaction gases=$SiH_4/WF_6$=1.0 (10 sccm in the experiments). Under these conditions, the ratio of hydrogen gas to the reaction gases was varied in the range of 0 to 1000 sccm.

Figure 8A:
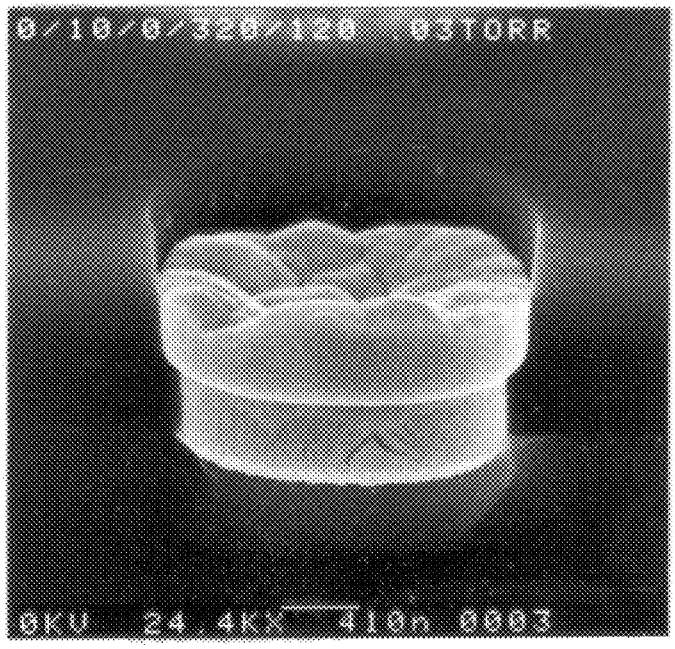
FIGS. 8A to 8F are photographs taken by the SEM showing enlarged images of crystalline structures of masses of columnar crystals.
Figure 8B:
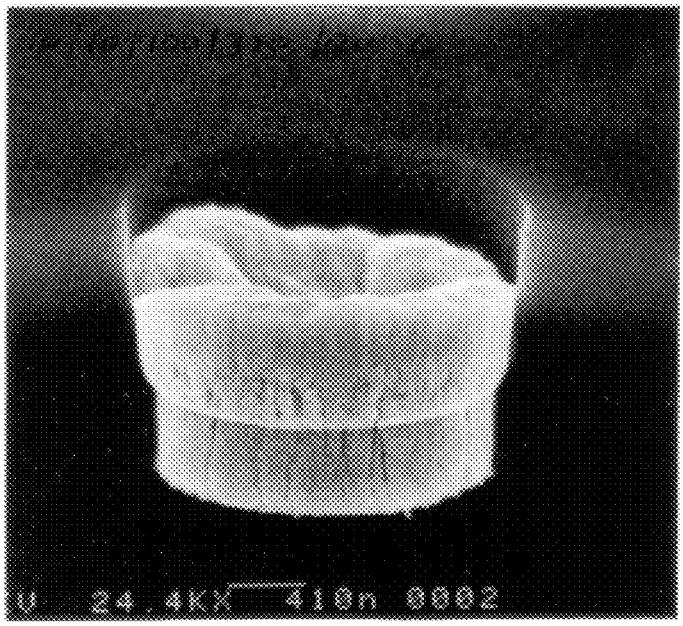
Figure 8C:
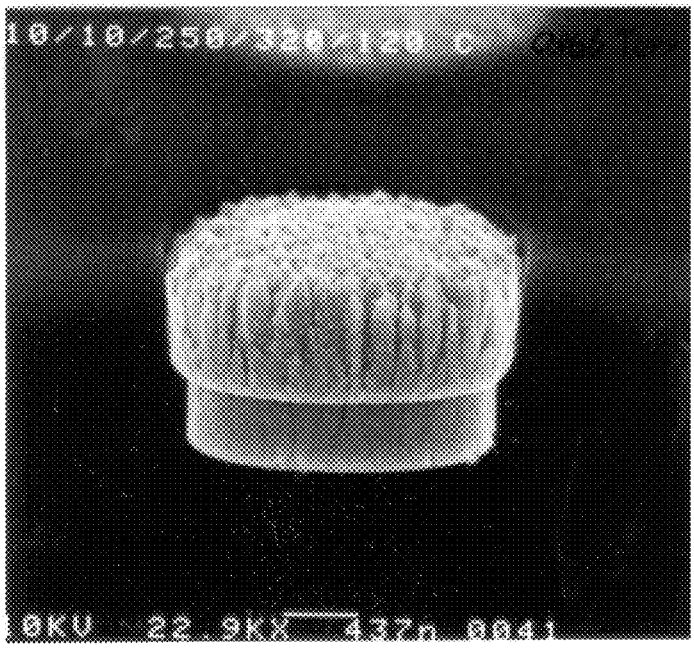
Figure 8D:
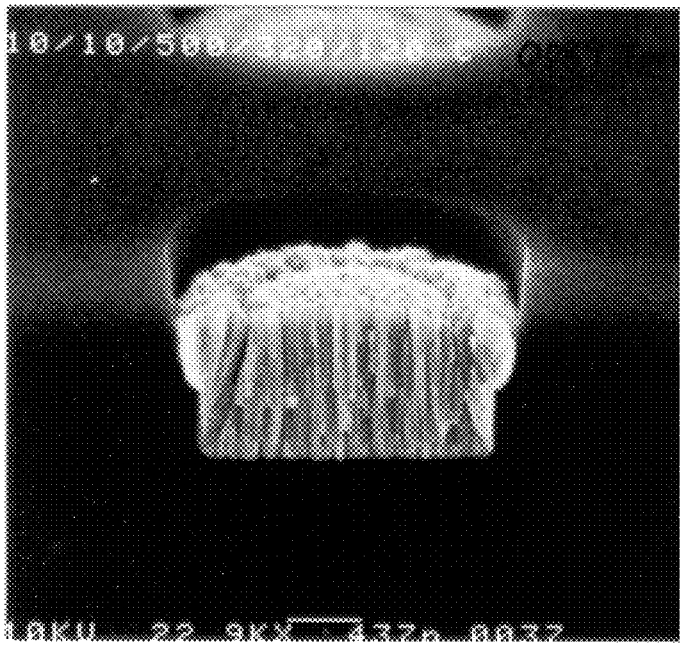
Figure 8E:
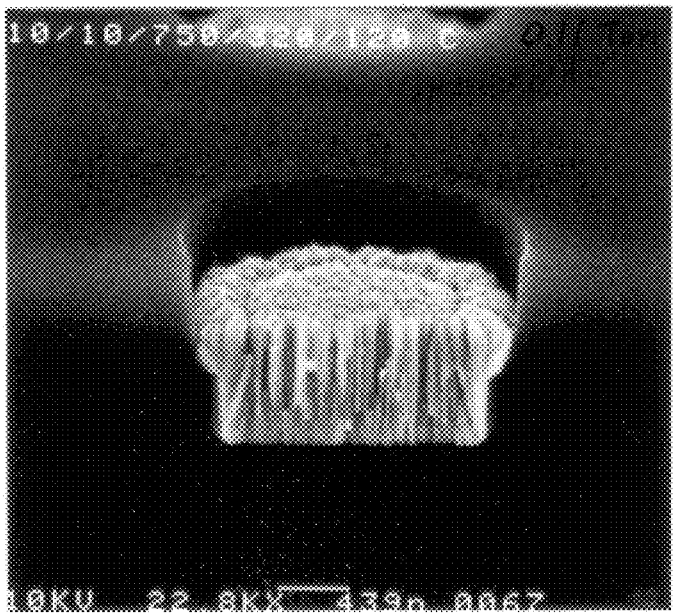
Figure 8F:
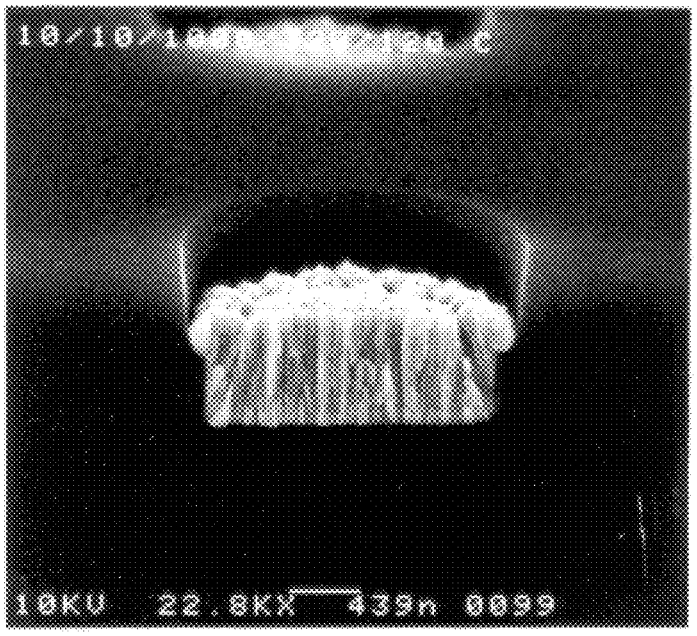

From FIG. 8B, it is understood that a most desirable shape can be obtained at the ratio of 25 (250 sccm) or above ($SiH_4$:$WF_6$:$H_2$=1:1:25 or above).

The height of the columnar crystal mass 27 is set to set to be short of the conductor film 25, by setting the time of the CVD process. Thereby, a predetermined gap for applying an electric field (i.e. for extracting electrons) is provided between the emitter electrode constituted by the columnar crystal mass 27 and the gate electrode constituted by the conductor film 25.

Figure 4D:
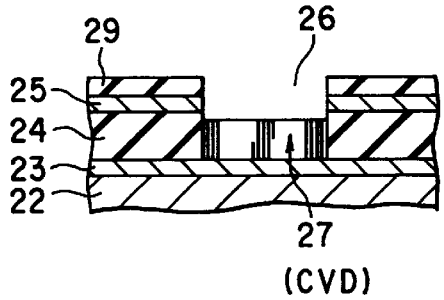

Since no free electrons are present in the region covered with the mask or insulating film 29, the columnar crystal mass 27 does not grow in this region when the CVD is performed. Accordingly, as shown in FIG. 4D, the columnar crystal mass 27 can be selectively formed only on the surface of the base electrode 23 alone.

An inert gas such as argon (Ar), neon (Ne) or helium (He) may also be used a gas for controlling the pressure within the reaction chamber. It was confirmed by experiments, however, that the selectivity of formation of the columnar crystal mass 27 was highest when hydrogen gas was introduced.

Even if argon gas, etc. is used, the columnar crystal mass 27 can be manufactured. However, the selectivity is degraded in this case. As a result, the columnar crystal mass 27 may also be formed on the location other than the surface of the base electrode 23, i.e. on the insulating film 29.

Considering the above, it is preferable to use hydrogen gas as a gas for controlling the pressure in this embodiment.

The degree of sharpness of the upper end portion of the columnar crystal 28 and the number of columnar crystals per unit area can be varied by setting film formation conditions.

Figure 4E:
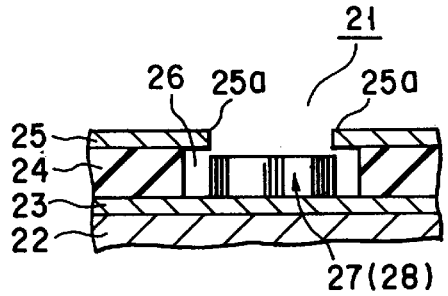

After the columnar crystal mass 27 has been formed, wet etching (isotropic etching) using HF is carried out. Thus, as shown in FIG. 4E, the insulating film 29 used as the mask and the insulating film 24 exposed to the through-hole 26 are selectively etched. Specifically, the insulating film 29 is etched in the intra-plane direction and a part of the lower insulating film 24 is further etched away in the intra-plane direction. Thereby, the edge portion 25*a* of the conductor film 25 projects into the through-hole 26. Thus, the electron emitting device 21, as shown in FIGS. 1 and 2, is obtained.

According to the above-described electron emitting device 21, the following advantages can be obtained.

First, many thin and sharpened emitter electrodes can be easily manufactured, and the electron emission efficiency of the electron emitting device 21 can be enhanced.

In the conventional electron emitting device (FIGS. 45 and 46B), it is necessary to sharpen the emitter electrodes (1, 3) by etching after film formation. For this purpose, a complex process must be performed. The degree of sharpness of the emitter electrode is determined by the resolution of the stepper, etc. at the time of patterning. Thus, the increase in degree of sharpness is limited.

In the conventional Spindt type electron emitting device (FIG. 45), the emitter electrode 1 has a pyramidal or conical shape. The increase in density of arrangement of emitter electrodes is prevented by the size of the bottom surface of each electrode.

By contrast, in the present invention, attention is paid to the fact that the mass 27 of fine columnar crystals 28 with sharpened tip portions 28*b* can be obtained at the time of film formation by the technique of CVD. Each columnar crystal 28 is used as emitter electrode. Thus, fully sharpened emitter electrodes can be formed at high density only by the technique of CVD.

Furthermore, since an electron emission unit (each emitter electrode) is a fine columnar crystal 28, the electron emission density can easily been enhanced.

Accordingly, fine and sharpened emitter electrodes can be manufactured at high density. Therefore, the electron emission efficiency can be enhanced and a higher emission current can be obtained with a lower voltage.

Since the resolution for patterning is not required, as mentioned above, the aforementioned electron emitting device can be manufactured by an apparatus with relatively low resolution, which is used in a conventional LCD (Liquid Crystal Display) manufacturing process, without using a high-resolution apparatus as used in a semiconductor manufacturing process. Therefore, an electron emitting device having sharpened emitter electrodes arranged at high density can easily been manufactured by inexpensive manufacturing equipment.

Secondly, an electron emitting device having more exactly uniform electron emission characteristics than in the prior art can be obtained.

Since in the conventional electron emitting device a complex process needs to be performed to sharpen the emitter electrode, reproducibility is low and it is difficult to obtain many uniform emitter electrodes. Thus, there is a concern that electronic emission characteristics vary from electron emitting device to electron emitting device.

However, since the emitter electrode of the electron emitting device 21 of this invention is a mass of many fine columnar crystals 28, the precision of shape of each columnar crystal 28 does not greatly affect the electron emission characteristics. Thus, the electron emitting device 21 having more exactly uniform electron emission characteristics can be obtained.

Thirdly, in the electron emitting device 21, the gate electrode is obtained by forming the through-hole 26 in the conductor film and forming the edge portion 25*a*. In addition, electrons extracted from the emitter electrode can be emitted to the vacuum via the through-hole 26.

With use of the single gate electrode (conductor film 25), electrons can be extracted from many fine emitter electrodes (columnar crystals 28). As mentioned above, the electron emitting device of this embodiment can function as a planar electron beam emission source.

Figure 45:
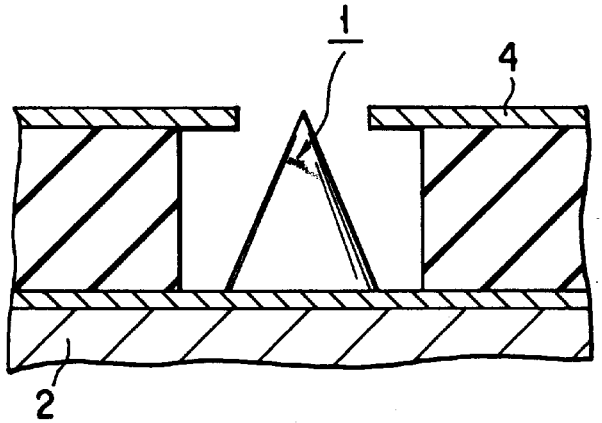
FIG. 45 (PRIOR ART)
FIG. 45 is a vertical cross-sectional view showing a conventional Spindt type electron emitting device.
Figure 46A:
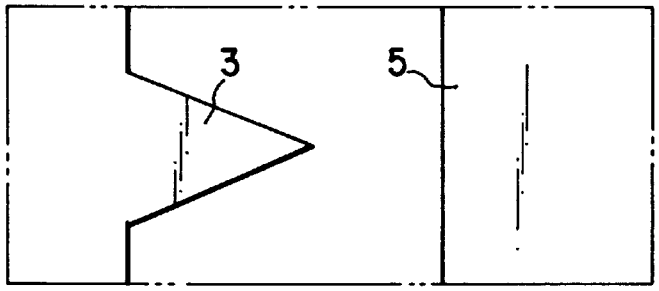
FIGS. 46A and 46B are a plan view and a vertical cross-sectional view of a conventional plane type electron emitting device.
Figure 46B:
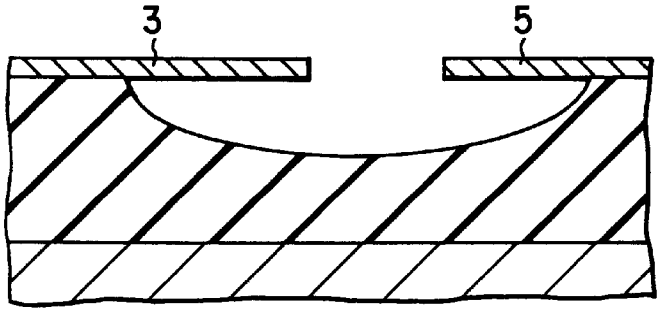

As compared to the conventional electron emitting device which is, as shown in FIGS. 45 and 46B, a point-type electron emission source with single emitter electrode 1, 3, the field electron emission efficiency and current density are high. In addition, since the electron emission device is a planar electron beam emission source, it is applicable to various fields.

Fourthly, since the columnar crystal 28 can be formed selectively on the substance including free electrons (the base electrode 23 in this embodiment) by CVD, the columnar crystal mass 27 can be formed on a desired region alone. Thus, the degree of freedom of arrangement of emitter electrodes is high. In particular, many electron emitting devices 21 can be easily arranged on single substrate 22 (refer to a third embodiment of the invention described below).

In the first embodiment, CVD is performed to deposit the columnar crystals 28 on the surface of the base electrode 23. However, the CVD may be replaced with, for example, sputtering.

In this embodiment, the β-W containing material is used as columnar crystals 28. However, the material is not limited if the columnar crystals can be obtained. For example, Al can be used as material of the columnar crystals 28. In this case, too, CVD or sputtering may be performed to deposit the columnar crystals 28.

The density of arrangement of the columnar crystals 28, etc. may be varied by changing the conditions for forming the columnar crystal mass 27. For example, in this embodiment the flow ratio of reaction gases is set at 1:1. However, this ratio may be varied if the desired columnar crystals 28 can be obtained. In addition, the ambient temperature within the chamber may be varied.

Furthermore, the through-hole 26 is circular in this embodiment. However, the through-hole 26 may have a square, oval, rectangular, or a slit-like shape with a predetermined length.

A second embodiment of the invention will now be described. The structural elements common to those in the first embodiment are denoted by like reference numerals and a description thereof is omitted.

Figure 9:
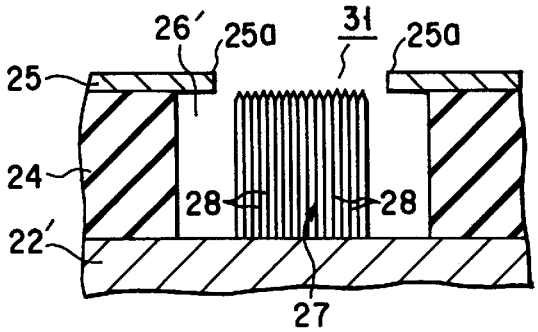
FIG. 9 is a vertical cross-sectional view showing an electron emitting device according to a second embodiment of the invention.

FIG. 9 shows an electron emitting device 31 according to the second embodiment. The columnar crystal mass 27 is formed directly on a substrate 22'.

The substrate 22' is a conductor such as a metal or Si including free electrons. Like the first embodiment, the columnar crystal mass 27 containing the β-W can be formed within the through-hole 26 alone by CVD.

Specifically, the base electrode 23 is used as conductor in the first embodiment, whereas the substrate 22' is used as conductor in the second embodiment.

With this structure, too, electrons can be emitted from the upper end portion of each columnar crystal 28 of the crystal mass 27 by providing a potential difference between the substrate 22' and conductor film 25 (gate electrode), and the same advantages as in the first embodiment can be obtained.

In other words, according to this structure, the columnar crystal mass 27, in which columnar crystals 28 capable of emitting electrons from needle-like end portions thereof are arranged at high density, can be used as emitter electrode of the electron emitting device. Since many sharpened emitter electrodes can be formed at high density, the electron emission efficiency is improved.

In addition, the aforementioned emitter electrode is formed by depositing the β-W containing columnar crystals 28 by CVD. Since the densely arranged emitter electrodes with sharpened tip portions can be obtained through the film formation step alone, the manufacture of the electron emitting device is made much easier.

A electron emitting device 32 according to a third embodiment of the invention will now be described with reference to FIGS. 10 and 11A to 11D. The structural elements common to those in the first embodiment are denoted by like reference numerals and a description thereof is omitted.

Figure 10:
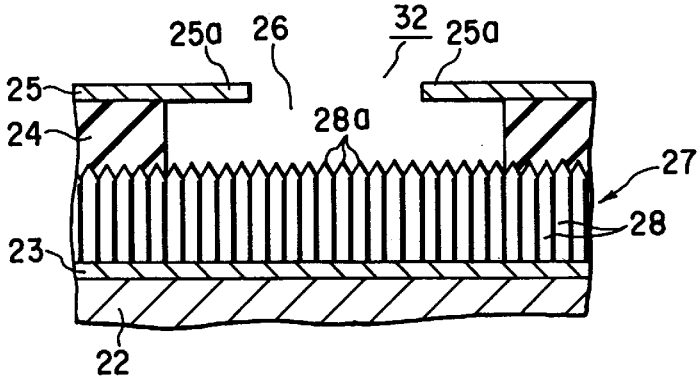
FIG. 10 is a vertical cross-sectional view showing an electron emitting device according to a third embodiment of the invention.

As is shown in FIG. 10, in the electron emitting device 32 of the third embodiment, a base electrode 23 (conductor), a columnar crystal mass 27 (emitter electrode), an insulating film 24 and a conductive film 25 (gate electrode) are successively laminated on a substrate 22.

The columnar crystal mass 27 is formed on substantially the entire surface of the base electrode 23 formed on the substrate 22. Unlike the first embodiment, the insulating film 24 is formed on the columnar crystal mass 27. A through-hole 26 is formed in the conductor film 25 and insulating film 24. The columnar crystal mass 27 is exposed in the through-hole 26.

In this embodiment, too, the insulating film 25 functions as gate electrode, and each columnar crystal 28 of the columnar crystal mass 27 functions as emitter electrode. When a negative voltage is applied to the conductor film 25 and a positive voltage is applied to the base electrode 23, a voltage is applied from an edge portion 25*a* of conductor film 25 to an upper end portion 28*a* of each columnar crystal 28 located in the through-hole 26. Thus, electrons are emitted from the upper end portion 28*a* of each columnar crystal 28.

A process for manufacturing the electron emitting device 32 according to the third embodiment will now be described with reference to FIGS. 11A to 11D.

Figure 11A:
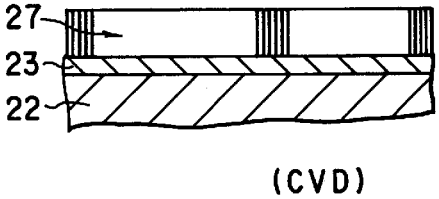
FIGS. 11A to 11D show the steps of a process for manufacturing the electron emitting device according to the third embodiment.

As is shown in FIG. 11A, the base electrode 23 and columnar crystal mass 27 are laminated on the surface of the substrate 22.

Like the first embodiment, the columnar crystal mass 27 is deposited by CVD. In this embodiment, however, no insulating film is present on the base electrode 23 and thus the columnar crystal mass 27 is formed over the entire base electrode 23 containing free electrons.

Figure 11B:
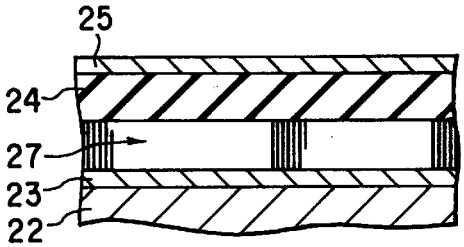
Figure 11C:
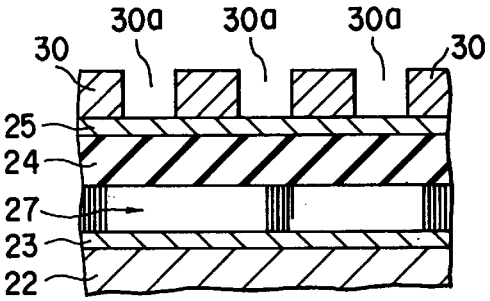

Subsequently, as shown in FIG. 11B, insulating film 24 and conductor film 25 are laminated on the columnar crystal mass 27. A resist 30 is then coated on the conductor film 25, as shown in FIG. 11C, and is patterned. Finally, the conductor film 25 and insulating film 24 are etched away by RIE and wet etching. As a result, the through-hole 26 (edge portion 25*a* of the gate electrode) is formed, and a field electron emission device 32, as shown in FIG. 11D, is obtained.

Figure 11D:
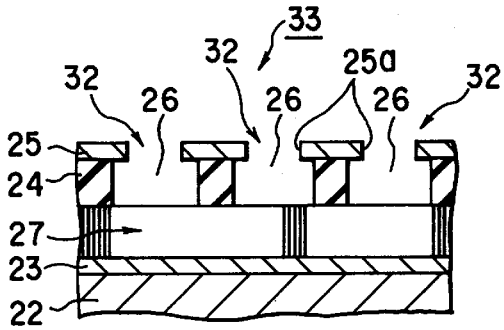

FIG. 11D shows a field electron emission source 33 wherein electron emitting devices 32 are integrated in an array. If a potential difference is provided between the base electrode 23 and conductor film 25, electrons are emitted from through-holes 26 formed in the conductor film 25.

With these electron emitting devices 32 and electron emission source 33, the same advantages as in the first embodiment can be obtained. The columnar crystal mass 27 constituting the emitter electrode may be formed on the location alone which corresponds to the through-holes 26 of the gate electrodes or may be formed on regions broader than the through-holes 26.

Figure 12:
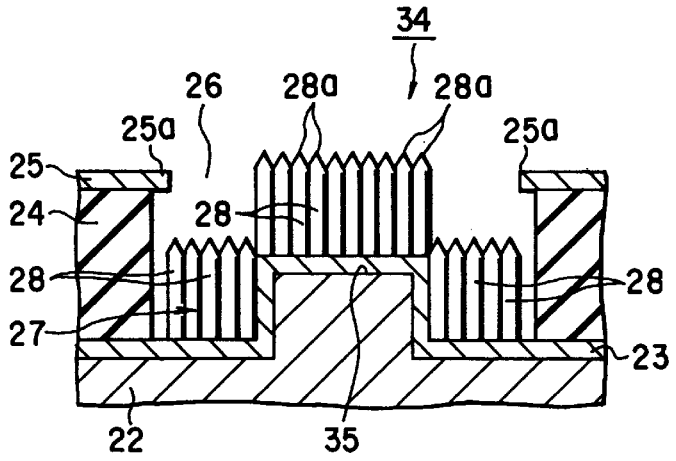
FIG. 12 is a vertical cross-sectional view showing an electron emitting device according to a fourth embodiment of the invention.

A fourth embodiment of the invention will now be described with reference to FIG. 12. The structural elements common to those in the first embodiment are denoted by like reference numerals and a description thereof is omitted.

In an electron emitting device 34 of this embodiment, a projection 35 is formed on a region of the substrate 22, which corresponds to a central portion of the through-hole 26. The projection 35 is elevated from a peripheral region thereof. Accordingly, if the electron emitting device is formed by the same process as with the first embodiment, columnar crystals 28 located at the central region of the through-hole 26 are projected from the peripheral columnar crystals 28.

In the first to third embodiments, the tip portions of all columnar crystals 28 are situated lower than the conductor film 25 (gate electrode). In the fourth embodiment, the tip portions of the columnar crystals 28 located at the central region of the through-hole 26 are situated higher than the conductor film 25 (gate electrode).

Thus, the upper end portions of the columnar crystals 28 located at the central region can be situated closer to the edge portions 25*a* of the conductor film 25 (gate electrode). Accordingly, an electric field can be effectively applied to the upper end portions of the columnar crystals 28 located at the central region, the degree of concentration of the electric field is made uniform, and the electron emission efficiency of the entire device is enhanced. Therefore, a high emission current can be obtained.

A fifth embodiment of the invention will now be described with reference to FIG. 13.

The electron emitting device 34 of the fourth embodiment is a modification of the first embodiment. On the other hand, an electron emitting device 37 of the fifth embodiment is a modification of the third embodiment (FIG. 10).

Like the fourth embodiment, a substrate 22 with a projection 35 is used. Using the substrate 22, the electron emitting device is manufactured by the same process as in the third embodiment. Thus, the electron emitting device 37 having the shape as shown in FIG. 13 can be obtained.

In this electron emitting device, unlike the fourth embodiment (FIG. 12), the columnar crystal mass 27 is formed over substantially the entire surface of the base electrode 23. The insulating film 24 and conductor film 25 are laminated on the columnar crystal mass 27. A through-hole 26 is formed through the insulating film 24 and conductor film 25, and a gate electrode (conductor film 25) is projected. The columnar crystals 28 formed on the upper surface (at a central region of through-hole 26) of the projection 35 are situated at a level higher than the peripheral columnar crystals 28. The upper end portions 28*a* of the crystals 28 are projected upward beyond the through-hole 26.

With this structure, too, the same advantages as with the fourth embodiment can be obtained.

In the fourth and fifth embodiments, the projection 35 on the substrate 22 may have various shapes, for example, a cylindrical shape or a rectangular shape.

The projection 35 may be produced by a general method, for example, by etching the substrate 22 or providing a projection on the substrate 22 by sputtering or deposition.

Figure 14:
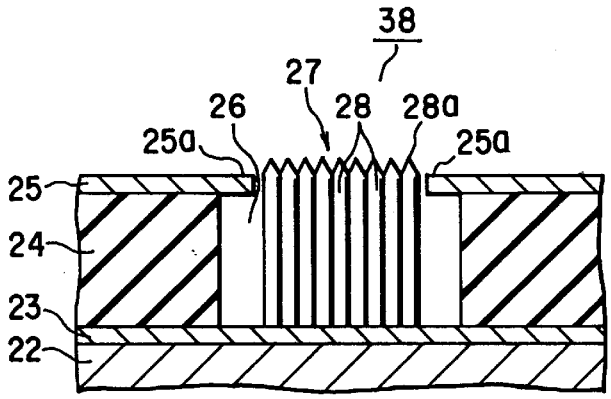
FIG. 14 is a vertical cross-sectional view showing an electron emitting device according to a sixth embodiment of the invention.

A sixth embodiment of the invention will now be described with reference to FIG. 14.

In the electron emitting device 38 of the sixth embodiment, unlike the fourth and fifth embodiments, the projection 35 is not provided on th substrate 22. The columnar crystal mass 27 is formed up to a high level so that the upper end portions 28*a* of all columnar crystals 28 may project upward from the through-hole 26.

In the sixth embodiment, the time period for CVD for growing the columnar crystals 28 is increased to grow each columnar crystal 28 up to a higher level.

In this structure, too, substantially the same advantages as with the fourth and fifth embodiments can be obtained.

A seventh embodiment of the invention will now be described with reference to FIG. 15.

In an electron emitting device 39 of this embodiment, a substantially pyramidal projection 40 is formed on the substrate 22. The projection 40 is situated at a substantially central area of a bottom region of a through-hole 26 extending through the insulating film 24 and conductive film 25.

A process for producing the substantially pyramidal projection 40 will now be described with reference to FIGS. 16A to 16C.

Figure 16A:
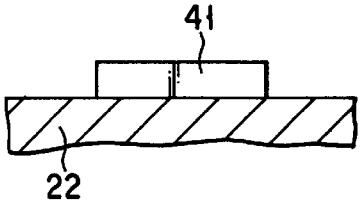
FIGS. 16A to 16C show the steps of a process for producing a projection of the electron emitting device according to the seventh embodiment of the invention.
Figure 16B:
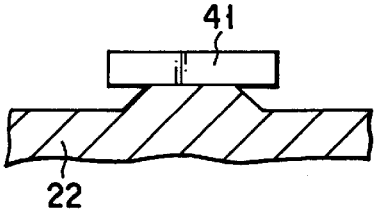
Figure 16C:
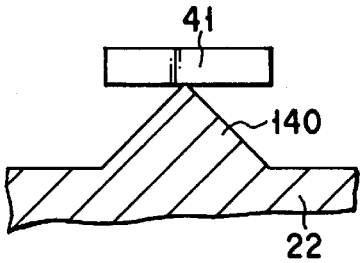
Figure 17:
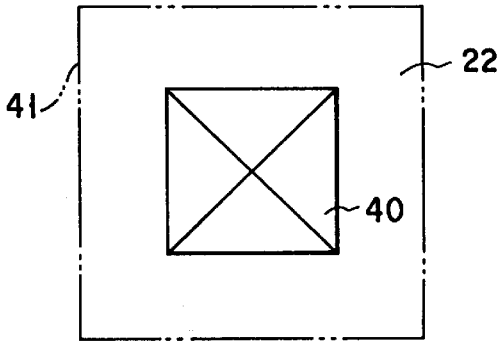
FIG. 17 is a plan view of the projection.

As is shown in FIG. 16A, a patterned insulating film ($SiO_2$) 41 is formed on the Si substrate. Using the insulating film 41 as a mask, isotropic etching (e.g. wet etching) is performed. Thus, the projection 40, as shown in FIGS. 16B and 16C, is formed. In this case, if the insulating film 31 is rectangular, the projection has a substantially pyramidal shape, as shown in FIG. 17.

Figure 15:
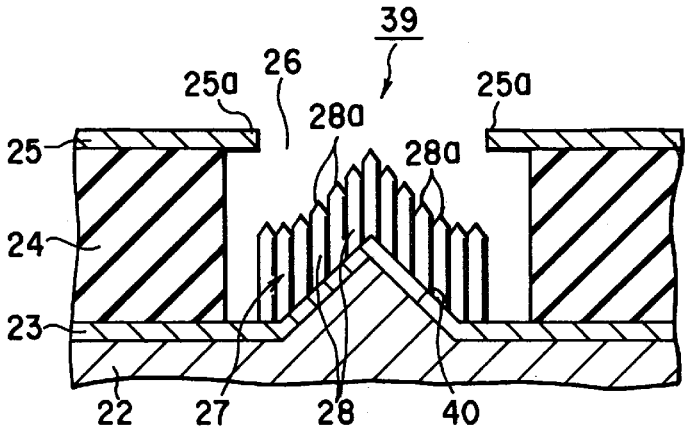
FIG. 15 is a vertical cross-sectional view showing an electron emitting device according to a seventh embodiment of the invention.

If the manufacturing process of the first embodiment is carried out by using the substrate 22, the electron emitting device 39 as shown in FIG. 15 is obtained. Specifically, the heights of the upper end portions of the columnar crystals 28 increase gradually from the periphery of the projection 40 towards the center of the hole 26. The upper end portion of the columnar crystal 28 located at the center of the through-hole 26 is highest.

According to this structure, the distance between the edge portion 25*a* of the conductor film 25 (gate electrode) and the upper end portion 28*a* of each columnar crystal 28 can be made substantially equal, as shown in FIG. 15. Thus, concentration of an electric field at the upper end portion 28*a* of each columnar crystal 28 is facilitated. In addition, since the central portion of the columnar crystal mass 27, as viewed as a whole, is tapered upwards, the electric field tends to be concentrated at the upper end portion of the highest columnar crystal 28.

Thus, the electron emission efficiency of this electron emitting device can be improved.

It is considered that electron emission is more difficult to occur towards the periphery of the projection 40 since a difference in height is provided among the upper end portions 28*a* of columnar crystals 28. However, electron emission can be caused at a lower application voltage than in each of the preceding embodiments at least at the central columnar crystal 28.

Figure 18:
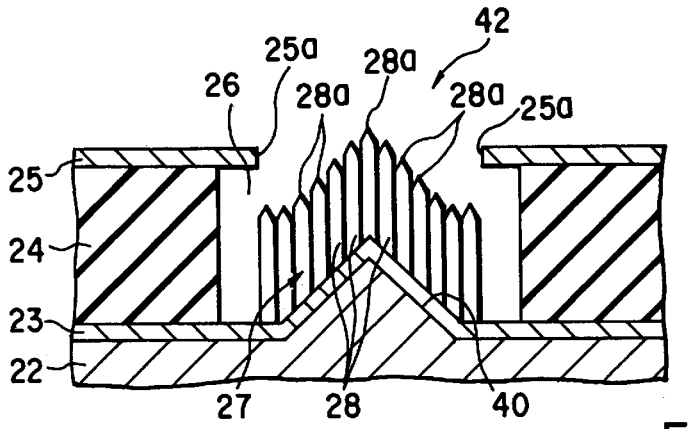
FIG. 18 is a vertical cross-sectional view showing an electron emitting device according to an eighth embodiment of the invention.

An eighth embodiment of the invention will now be described with reference to FIG. 18.

In the seventh embodiment, the highest tip portion 28*a* of the columnar crystal mass 27 is located at a substantially equal or lower level than the conductor film 25. By contrast, in the electron emitting device 42 of the eighth embodiment, the highest tip portion of the columnar crystal mass 27 (upper end portion 28*a* of the columnar crystal 28 located at the center of the through-hole 26) projects upwards and is higher than the conductor film 25.

This columnar crystal mass 27 can be formed by setting a time period for CVD to be longer in the seventh embodiment.

According to this structure, substantially the same advantage as with the seventh embodiment can be obtained, and the degree of concentration of the electric field at the tip end portion 28*a* of the central columnar crystal 28 can be increased.

In the seventh and eighth embodiments, the manufacturing process of the first embodiment is applied to the substrate 22 having the projection 40, thereby obtaining the electron emitting devices 39 and 42. However, an electron emitting device may be obtained by applying the manufacturing process of the third embodiment.

Figure 13:
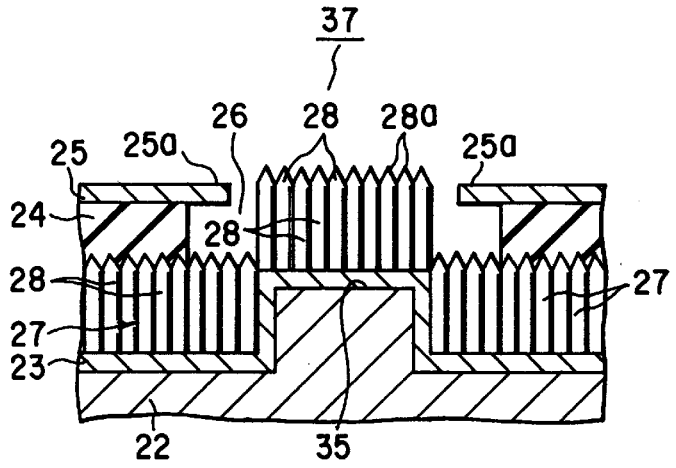
FIG. 13 is a vertical cross-sectional view showing an electron emitting device according to a fifth embodiment of the invention.

In this case, the insulating film 24 and conductor film 25 (gate electrodes) are formed on the columnar crystal mass 27 formed on the flat surface of the substrate 22 (see FIG. 13).

In the above-described first to eighth embodiments, the structures of the electron emitting devices themselves have been described. However, the use of the electron emitting device may be freely chosen. For example, the electron emitting device may be applied to a plane emission type planar display apparatus, an SEM (Scanning Electronic Microscope), an electron beam direct plotting apparatus, or an electron emission source of, e.g. an exposing device for producing a reticle.

In the following ninth and tenth embodiments, the electron emitting device is applied to a planar display apparatus.

A planar display apparatus according to the ninth embodiment will now be described with reference to FIGS. 19 to 21.

Figure 20:
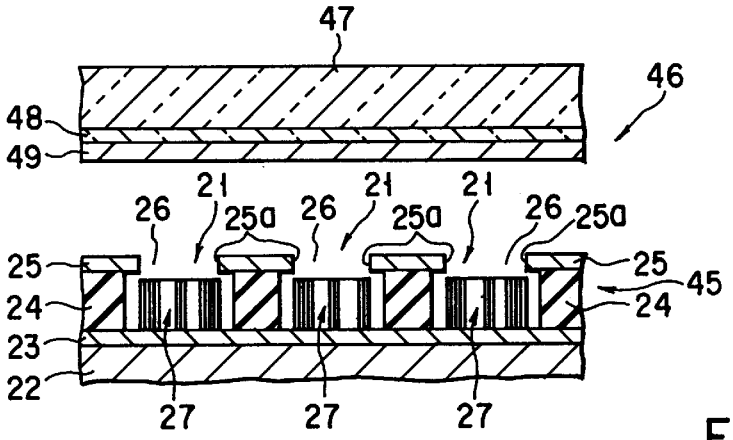
FIG. 20 is a vertical cross-sectional view of the device of the ninth embodiment, taken along line 20—20 in FIG. 19.
Figure 21:
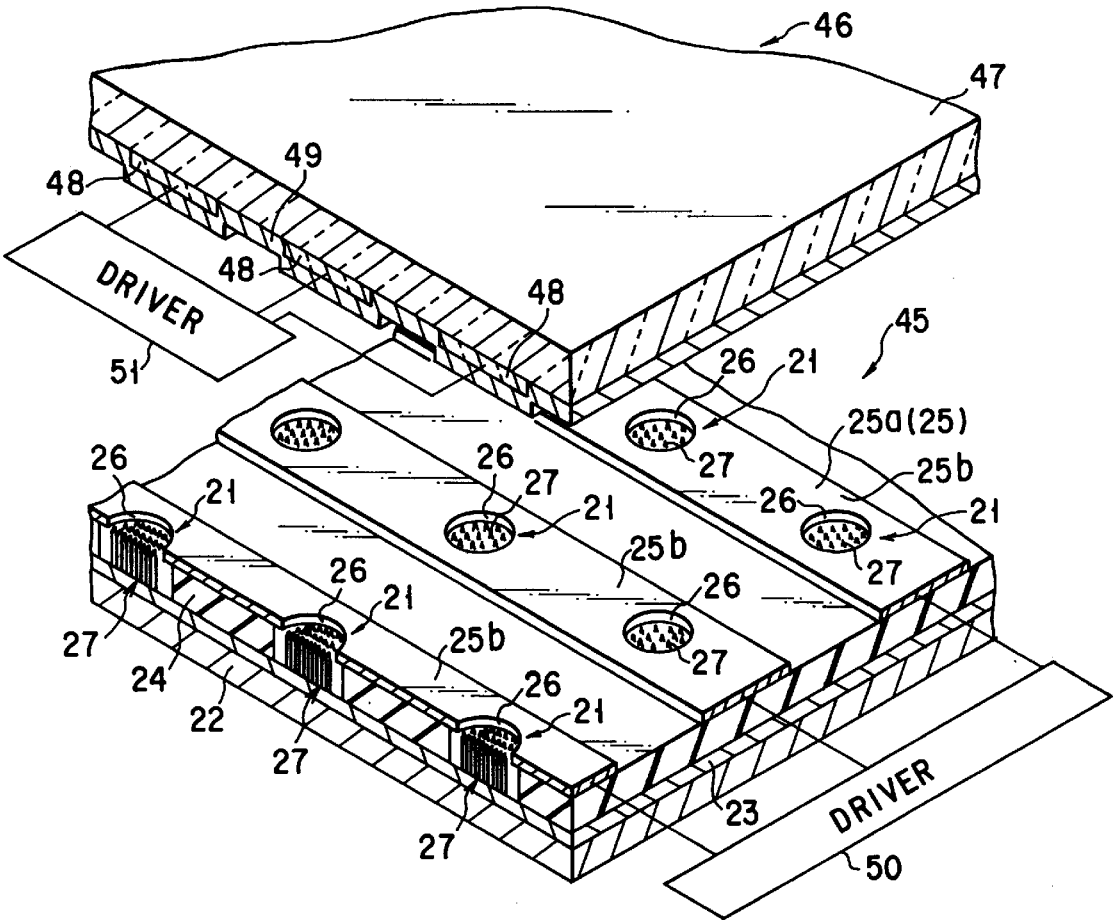
FIG. 21 is a perspective view of the planar display device according to the ninth embodiment.

FIGS. 20 and 21 show the structure of the planar display apparatus which comprises an electron emission source 45 formed by integrating the electron emitting devices 21 of the first embodiment, and a display unit 46 for receiving electrons emitted from the electron emission source 45 and effecting light-emission display.

The electron emission source 45 is manufactured in the following manner.

At first, a base electrode 23, an insulating film 24 and a conductor film 25 are laminated on the substrate 22. Then, as shown in FIG. 20, the uppermost conductor film 25 is divided into many strip-like conductor films 25*a* by means of etching, etc. Thereby, address lines are formed.

Subsequently, predetermined portions of the insulating film 24 and conductor film 25*b* are etched, and the through-holes 26 are formed. The through-holes 26 are formed at predetermined intervals along each strip-like conductor film 25*b*. A number of through-holes 26 are formed on the base electrode 23 in a matrix.

Figure 5B:
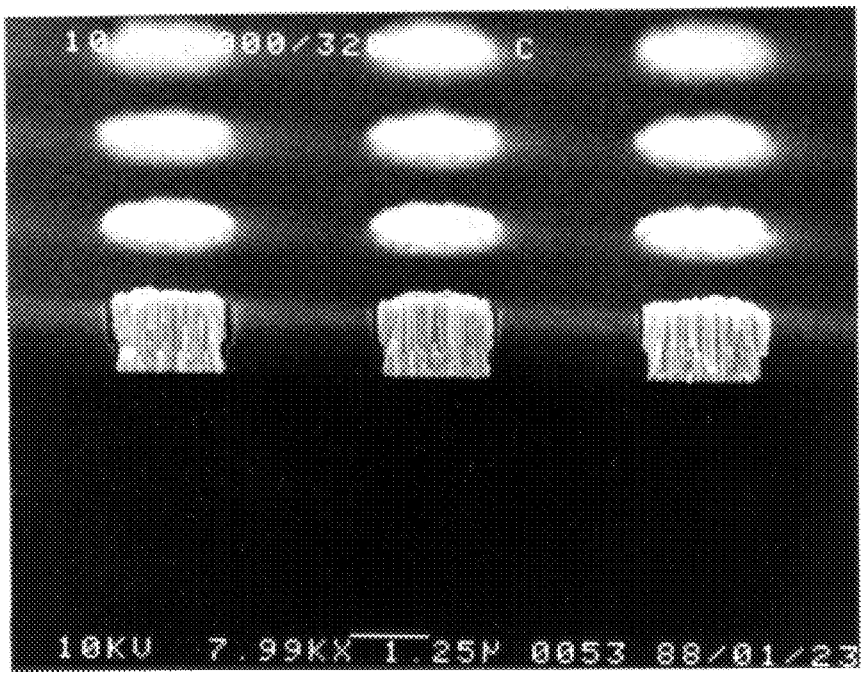

Then, the substrate 22 is held within a reduced-pressure chamber and subjected to CVD, like the first embodiment. Thereby, columnar crystal masses 27 (emitter electrodes) are formed on the surface portions alone of the base electrode 23, which are exposed to the through-holes 26. FIG. 5B is an SEM photograph of many columnar crystal masses 27 thus formed.

Finally, the conductor film 26 (insulating film 24) exposed to the through-holes 26 are etched away (wet etching by HF), and the edge portions 25*a* of conductor film 25 are made to project into the through-holes 26. Thus, the gate electrodes are formed.

Figure 19:
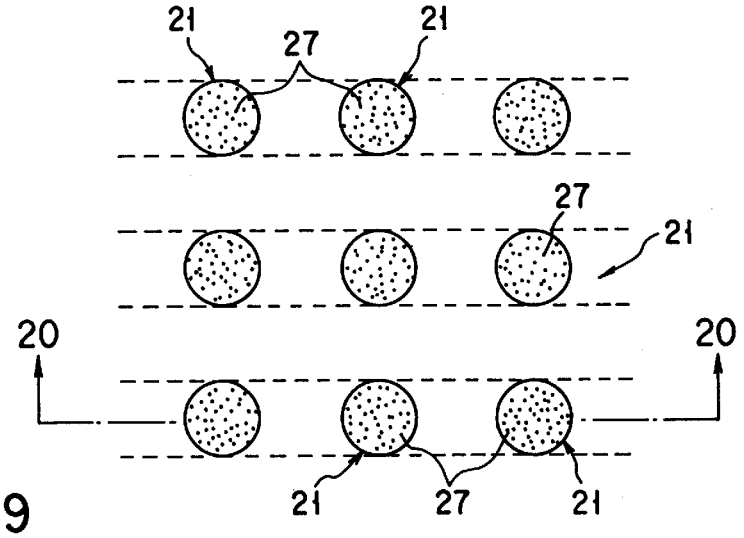
FIG. 19 is a plan view showing a part of a planar display device according to a ninth embodiment of the invention.

Through the above steps, the electron emission source 45 in which many electron emitting devices 21 are integrated in a matrix is obtained (see FIG. 19).

On the other hand, the display unit 46 comprises a transparent substrate (quarts glass, etc.) 47, many strip-like transparent conductor films 48 (anode electrodes) coated on the surface of the substrate 47, which faces the electron emission source 45, and extending perpendicular to the conductor films 25*b*, and a multi-color light emission phosphor 49 coated to cover the surfaces of the transparent conductor films 48.

For example, ITO (Indium Tin Oxide) films are used as the transparent conductor films 48. The ITO films are indium oxide films doped with tin oxide, and have both electrical conductivity and light transmission properties.

The multi-color light emission phosphor 49 is a phosphor for low-acceleration electron beams and is, for example, ZnO:Zn.

The strip-like transparent conductor films 48 constitute data lines which are associated with address lines (conductor films 25*b*) formed on the electron emission source 45.

Finally, the display unit 46 and electron emission source 45 are bonded to each other at edge portions thereof (not shown). The bonding is effected, for example, in a vacuum atmosphere by using electrostatic bonding. A vacuum is kept in the space interposed between the display unit 46 and electron emission source 45.

In the planar display apparatus thus constructed, each electron emitting device 21 constitutes one pixel of the planar display apparatus.

Specifically, each pixel of this planar display apparatus is constituted by the electron emitting device which is a triode tube having the emitter electrode formed of the columnar crystal mass 27, wherein a phosphor is provided on the anode of the triode and the phosphor is caused to emit light by emitted electrons.

If drivers 50 and 51 are connected to the address lines formed of the conductor films 25*b* of the electron emission source 45 and the data lines formed of the transparent conductor films 48 of the display unit 46, the planar display apparatus can be driven in the same manner as with, for example, a single matrix type liquid crystal display apparatus.

More specifically, no voltage is applied to the base electrode 23 and the base electrode 23 is set at a ground potential level (0 V). A high voltage is applied to a predetermined address line (conductor film 25*b*). By a potential difference therebetween, electrons are emitted from a chosen one of the electron emitting devices 21 provided on the predetermined address line.

On the other hand, the emitted electrons are attracted and converted to the data line (transparent conductor film 48) to which a selection voltage has been applied. Thus, the phosphor 49 located at a desired position is made to emit light, and the display unit 46 is made to show a necessary display.

According to the above structure, the following advantages can be obtained.

First, a planar display apparatus functioning very well with a low operating power can be obtained.

Specifically, the electron emitting device 21 of the present invention is a planar electron beam emission source with very high electron emission efficiency. Thus, if the electron emission source 45 of the planar display apparatus is constituted by integrating the electron emitting devices 21 at high density, it is possible to obtain a planar display apparatus which functions well with a low operating power and has high luminance.

In the present invention, as described above, a sharpened emitter electrode is obtained by making use of the shapes of crystals of the columnar crystal mass 28. Thus, the emitter electrode can be formed more easily with less defects. Thus, the yield of planar display apparatuses can be increased.

Secondly, the pixels of the planar display apparatus can be arranged at very high density.

Specifically, in this planar display apparatus, even if the electron emitting devices 21 constituting individual pixels are arranged close to each other, no problem arises if the distance between the electron emitting devices 21 is greater than the distance between the emitter electrode (upper end portion of columnar crystal mass 27) and the gate electrode (conductor film 25*b*).

Accordingly, such a problem as crosstalk does not arise, even if the pixels are arranged at high density by decreasing the distance between the electron emitting devices 21, and the address lines are formed on the side of the electron emission source 45 at narrow intervals.

Thirdly, according to the above structure, dispersing electron beams can be converged by providing data lines on the side of the display unit 46, and the locations where light is emitted can be exactly controlled.

Fourthly, according to the above structure, it is possible to obtain an electron emitting source in which electron emitting devices (triodes) having columnar crystal masses 27 as emitter electrodes are integrated. Electrons extracted from the emitter electrodes are emitted through the holes formed in the gate electrodes. In this case, electrons can be emitted with a desired one of the electron emitting devices selected.

In the present embodiment, many circular through-holes 26 are formed along the address lines (conductor films 25*b*). The present invention, however, is not limited to this structure. For example, the circular through-holes may be replaced with slit-like through-holes all connected along the address lines, and the columnar crystal masses 27 may be formed through the slit-like through-holes. In this case, the columnar crystal mass 27 is formed linearly along the shape of the slit-like through-hole.

In this embodiment, one pixel is formed by one electron emitting device 21. The present invention, however, is not limited to this structure. One pixel may be constituted by a plurality of electron emitting devices. For example, as shown in FIG. 30B, one pixel may be constituted by eight electron emitting devices 21.

A planar display apparatus according to the tenth embodiment will now be described with reference to FIG. 22. The structural elements common to those in the ninth embodiment are denoted by like reference numerals and a description thereof is omitted.

The planar display apparatus according to the tenth embodiment differs from the ninth embodiment in that both address lines and data lines are formed on the side of the electron emission source 45'.

Specifically, the base electrode 23 is divided into strip-like base electrodes 23*a* extending perpendicular to the strip-like conductor films 25*b*. The base electrodes 23*a* are used as address lines, and the strip-like conductor films 25*b* are used as data lines.

After the divided base electrodes 23*a* are formed on the substrate 22, the same process as in the ninth embodiment is performed. Thus, the electron emission source 45' having the shape as shown in FIG. 22 is obtained.

On the other hand, unlike the ninth embodiment, a transparent conductor film 48 of the display unit 46' is not divided and is coated over the entire surface of the transparent substrate 47. The multi-color light emission phosphor 49 is formed on the surface of the transparent conductor film 48.

This planar display apparatus can perform a display function by the same driving method as with an active matrix type liquid crystal display apparatus using TFTs.

Specifically, the drivers 50 and 51 connected to the lines (25*b*, 23*a*) are activated and a voltage is applied to chosen address line (23*a*) and data line (25*b*). Thus, electrons are emitted from the electron emitting device 21 provided at an intersection of the chosen lines.

In this case, if a voltage higher than a voltage, which has been applied to the conductor films 25*b*, is applied to the transparent conductor film 48 provided in the display unit 46', almost all emitted electrons are attracted to the transparent conductor film 48 and collide with the phosphor 49 coated on the surface of the transparent conductor film 48. Thus, the phosphor 49 emits light.

According to this structure, substantially the same advantage as in the ninth embodiment can be obtained. In this embodiment, one pixel is formed by one electron emitting device 21. The present invention, however, is not limited to this structure. One pixel may be constituted by a plurality of electron emitting devices. For example, as shown in FIG. 30B, one pixel may be constituted by eight electron emitting devices 21. A planar display apparatus according to an eleventh embodiment will now be described with reference to FIGS. 23 and 24A to 24E.

The planar display apparatus according to the eleventh embodiment has an electron emission source 52 in which the electron emitting devices 32 of the third embodiment are integrated.

Specifically, a columnar crystal mass 27 is formed over the entire surface of the base electrode 23 coated on the surface of the substrate 22. An insulating film 24 and a conductor film 25 (25*b*) are laminated on the columnar crystal mass 27.

Like the ninth embodiment, the conductor film 25 is divided into strip-like conductor films 25*b* which constitute address lines. On the other hand, through-holes 26 for exposing the columnar crystal mass 27 are formed in the strip-like conductor films 25*b* and insulating film 24.

In the ninth embodiment, the through-holes 26 are provided linearly along each conductor film 25*b*. However, as in the present embodiment, the through-holes 26 may be provided in two or more lines or in a staggering arrangement.

The display unit 46 has the same structure as that in the ninth embodiment. Specifically, strip-like transparent conductor films 48 are formed on the transparent substrate 47 and function as data lines.

This planar display apparatus can be driven by the same driving method as with a simple matrix type liquid crystal display apparatus.

A process of manufacturing the planar display apparatus according to the eleventh embodiment will now be described with reference to FIGS. 24A to 24E.

Figure 24A:
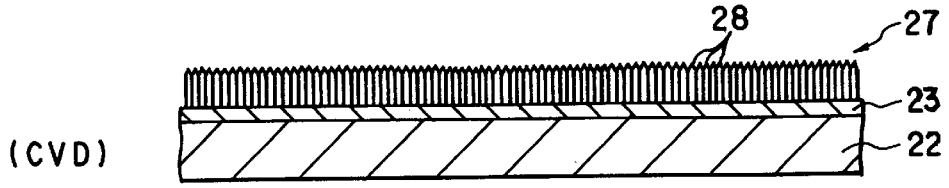
FIGS. 24A to 24E show the steps of a process for manufacturing the planar display device according to the eleventh embodiment.

At first, as shown in FIG. 24A, a thin-film base electrode 23 is formed on the surface of the substrate 22, and a columnar crystal mass 27 is formed on the base electrode 23. Like the first embodiment, the columnar crystal mass 27 is formed by CVD.

Figure 24B:
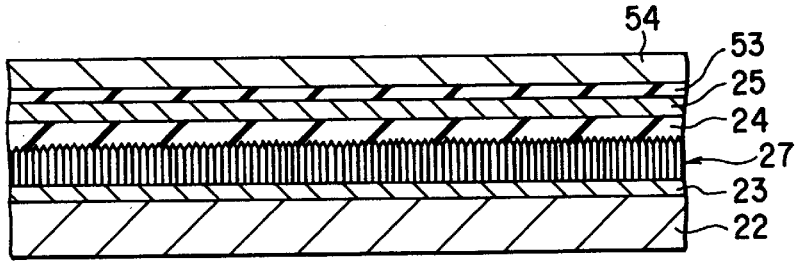
Figure 24C:
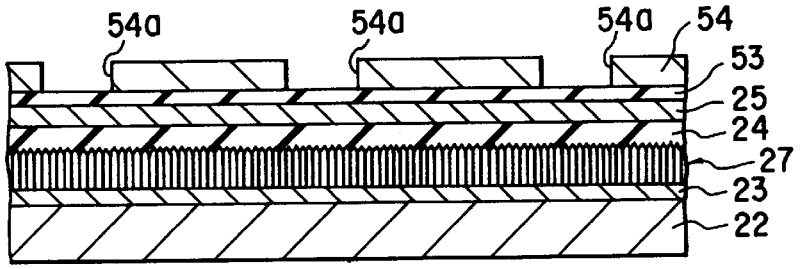

Then, as shown in FIG. 24B, a first insulating film 24 (conductor film 24), a conductor film 25 and a second insulating film 53 are laminated on the columnar crystal mass 27. A resist 54 is coated on the surface of the second insulating film 53. Subsequently, the resist 54 is patterned and, as shown in FIG. 24C, pattern holes 54*a* for forming through-holes 26 are made. For example, each pattern hole 54*a* is formed circular.

Figure 24D:
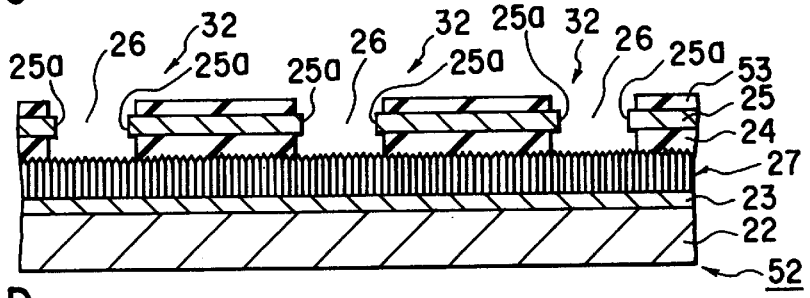

After the through-holes 26 are formed by anisotropic etching with the resist 54 used as a mask, the first and second insulating films 24 and 53 are selectively etched by wet etching using HF. Thus, edge portions 25*a* of the conductor films 25 are projected into the through-holes 26, as shown in FIG. 24D, and gate electrodes are formed. Then, the resist 54 is washed and removed, and the electron emitting source 52 is completed.

Following the above, the display unit 46 is fixed to the top surface of the electron emission source 52. In the display unit 46, the transparent conductor films 48 are formed as data lines by the process described above in connection with the ninth embodiment.

Figure 24E:
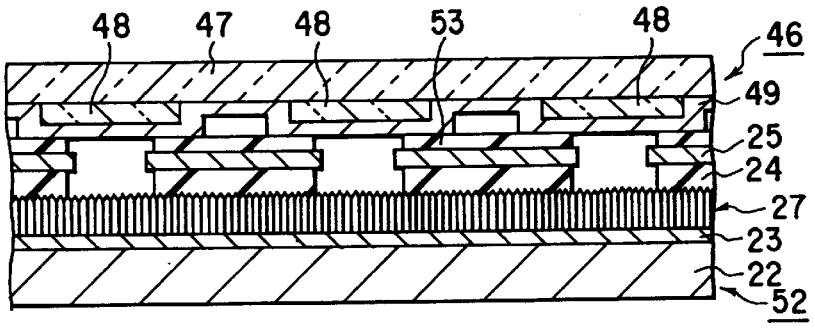

As is shown in FIG. 24E, the display unit 46 is fixed to the electron emission source 52 in such manner that the through-holes 26 are sealed in a vacuum by those portions of the phosphor 49 which correspond to the transparent conductor film 48. Thus, the upper surface of the second insulating film 53 is adhered to the lower surface of the phosphor 49.

The planar display apparatus is completed through the above steps.

According to the planar display apparatus, the same advantage as with the ninth embodiment can be obtained. Specifically, fine emitter electrodes with sharpened tip portions can be formed at high density, only by providing the crystal mass of columnar crystals on the conductor in the film formation step in the process of manufacturing the planar display apparatus.

In this embodiment, the columnar crystal mass 27 is formed on substantially the entire surface of the base electrode 23, and the electron emission position is controlled by the position of the through-hole 26 formed in the conductor film 25. Thus, the degree of freedom of electron emission position is high, and also the degree of freedom for the manufacturing process is high.

For example, a conductor film with many through-holes is prepared and this conductor film is coated on the columnar crystal mass 27. By this method, too, the electron emission source 52 of the same shape as with the eleventh embodiment can be obtained.

Furthermore, according to the process of manufacturing the planar display apparatus of this embodiment, the second insulating film 53 formed on the conductor film 25 functioning as gate electrode may be used as a spacer between the transparent conductor film 48 and conductor film 25*b* (gate electrode 25), as shown in FIG. 24E. Therefore, another spacer such as beads is not necessary, and the manufacture of this planar display apparatus is remarkably made easier.

A twelfth embodiment of the invention will now be described with reference to FIGS. 25 to 30C. The structural elements common to those of the electron emitting device of the first embodiment are denoted by like reference numerals and a description thereof is omitted.

Figure 25:
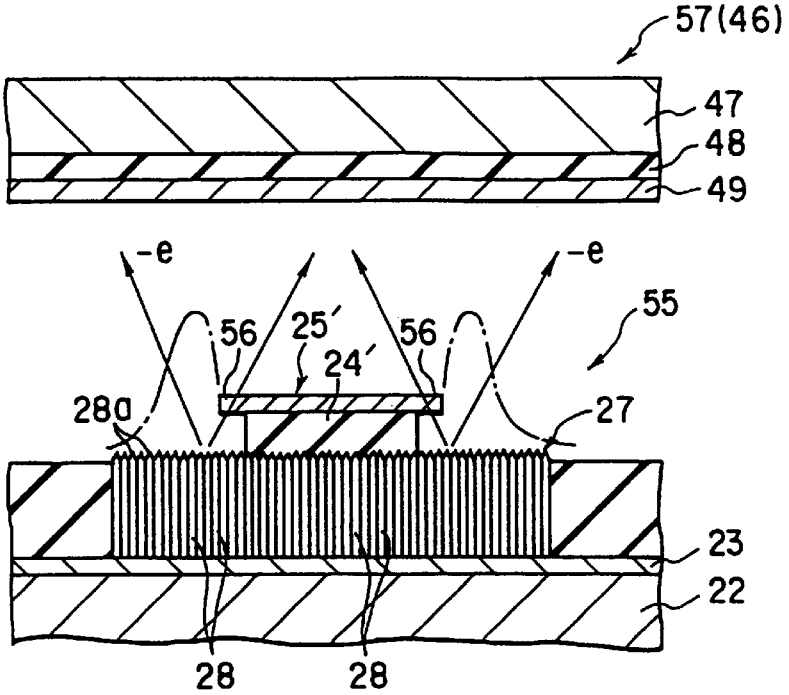
FIG. 25 is a cross-sectional view of a planar display device according to a twelfth embodiment of the invention.
Figure 26:
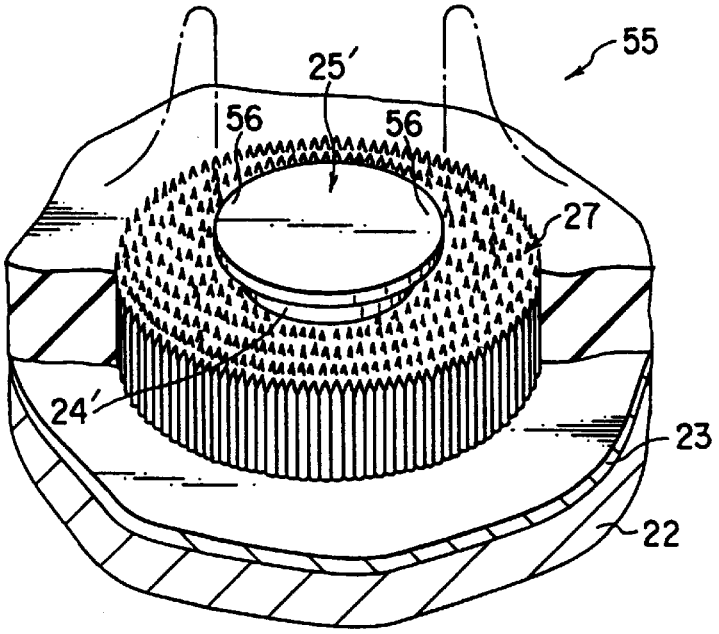
FIG. 26 is a perspective view of the planar display device according to the twelfth embodiment.

FIGS. 25 and 26 show an electron emitting device 55 of the twelfth embodiment. A base electrode 23 is formed on a substrate 22, and a columnar crystal mass 27 functioning as an emitter electrode is formed on the base electrode 23. The columnar crystal mass 27 is formed over a predetermined area by the same method (patterning, exposure, CVD) as in the first or second embodiment.

An insulating film 24' is formed on a central area of the upper surface of the crystal mass 27. A conductor film 25' functioning as a gate electrode is formed on the insulating film 24'. The conductor film 25' has an edge portion 56 projecting outwards beyond the insulating film 24'.

In this embodiment, as shown in FIG. 26, the columnar crystal mass 27 is formed on a circular area, and the conductor film 25' is formed on a circular area smaller than the area of the crystal mass 27. Thus, the columnar crystal mass 27 extends radially outward of the conductor film 25' so as to surround the conductor film 25'.

Next, the operation of the electron emitting device 55 will be described.

A negative voltage is applied to the base electrode 23 and a positive voltage is applied to the conductor film 25' (gate electrode), thereby providing a potential difference between the columnar crystal mass 27 and the conductor film 25'. Consequently, a voltage is applied from the edge portion 56 of the conductor film 25' to the upper end portion of the crystal mass 27.

The applied voltage is concentrated at the upper end portion of each columnar crystal 28 of the crystal mass 27, and electrons are emitted from the upper end portion 28*a* of each columnar crystal 28. The amount of emitted electrons varies, as indicated by dot-and-dash lines in FIG. 26. Specifically, the amount of electrons emitted from the columnar crystal 28 closest to the edge portion 56 of the conductor film 25' is greatest, and the amount of emitted electrons decreases gradually in the radially outward direction. The reason for this is that the electron emission efficiency depends greatly upon the physical distance from the edge portion 56 of the gate electrode (conductor film 25').

Figure 27:
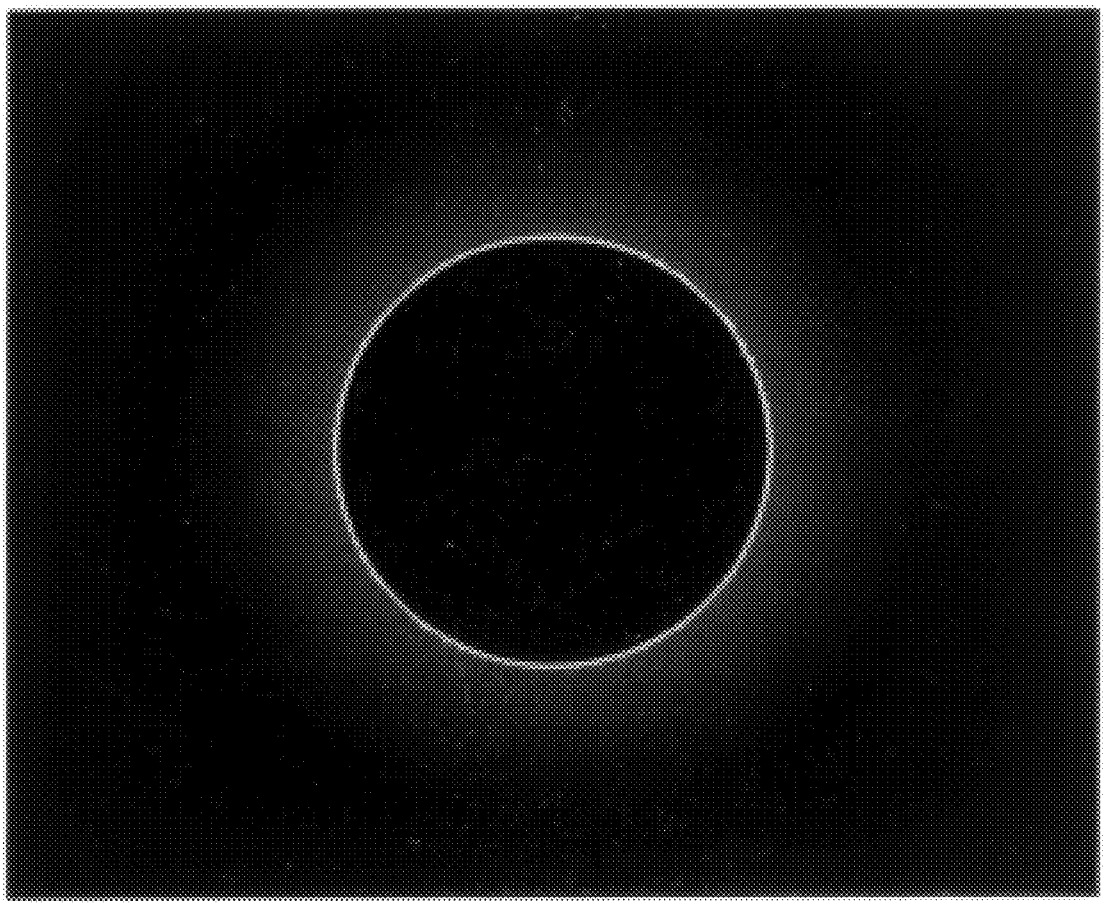
FIG. 27 is a plan view showing an electron emission pattern of the planar display device according to the twelfth embodiment.

Accordingly, in the case where the edge portion 56 of the conductor film 25' is formed circular, as in the present embodiment, the electrons are emitted in an almost annular shape. FIG. 27 shows the state in which the phosphor 49 of the anode electrode 57 (corresponding to the display unit 46 of the tenth embodiment) is made to emit light in an annular fashion by electrons released from the electron emitting device 55 of this embodiment.

Figure 28:
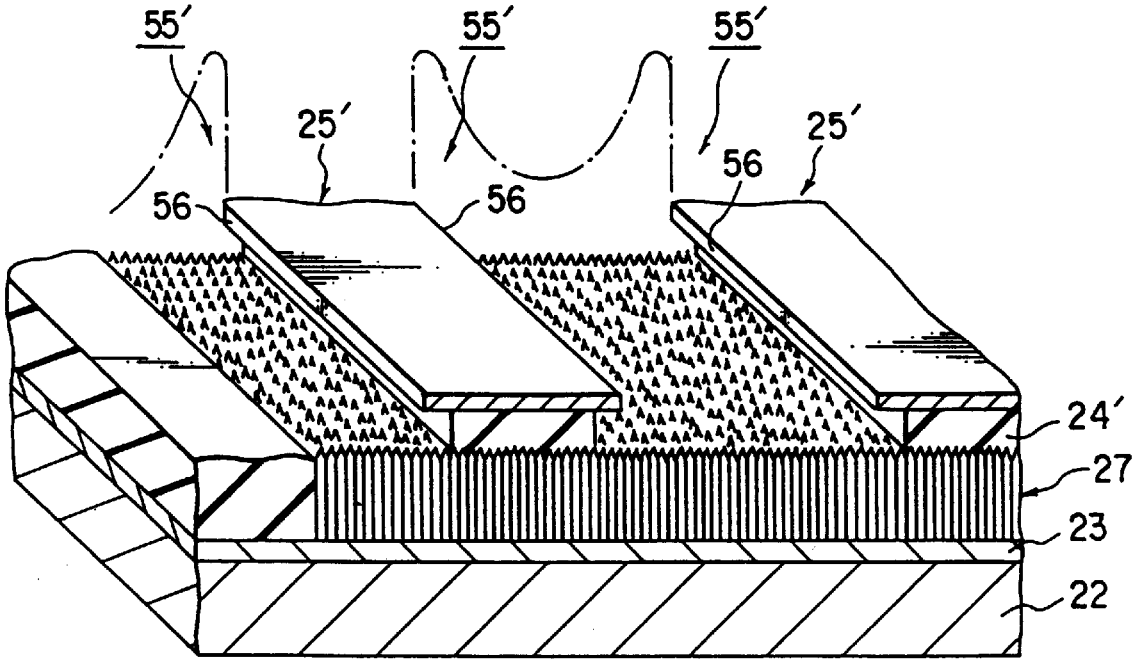
FIG. 28 is a perspective view showing another example of the planar display device according to the twelfth embodiment.

On the other hand, FIG. 28 shows an electron emitting device 55, having a linear edge portion 56 of a conductor film 25'. In the electron emitting device of this embodiment, the shape of the edge portion 56 may be freely chosen.

In the electron emitting device 55' shown in FIG. 28, slits are formed in the conductor film 25'. Thereby, the edge portions 56 are formed. In this embodiment, too, the electron emission efficiency is highest in a region near the edge portion 56. Thus, the electron emission amount varies, as indicated by dot-and-dash lines in FIG. 28.

Figure 29:
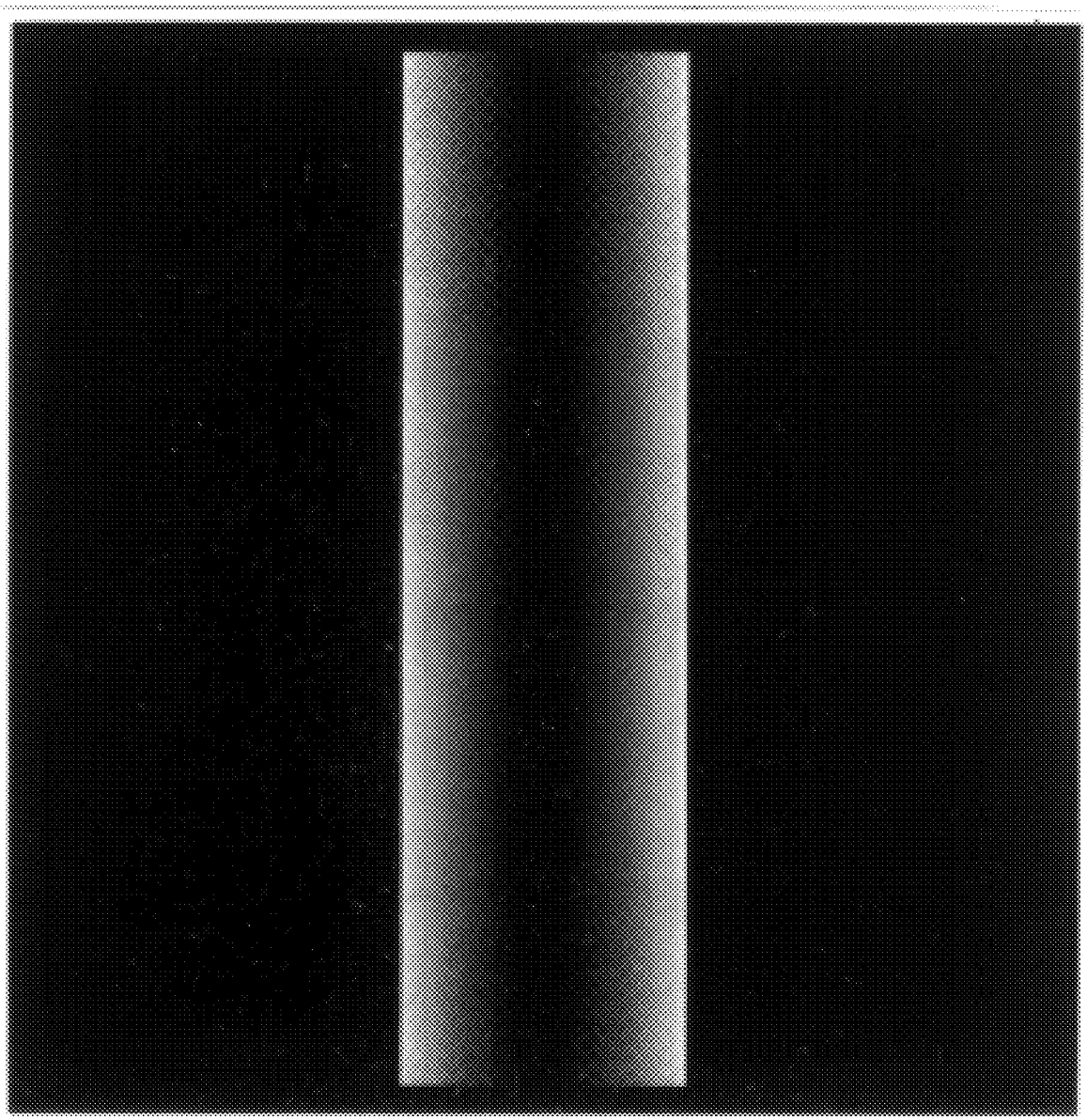
FIG. 29 is a plan view showing an electron emission pattern of the example of the planar display device according to the twelfth embodiment.

Accordingly, when the phosphor of the anode electrode (not shown in FIG. 28) is made to emit light by electrons released from the electron emitting device 55', a parallel linear light emission state, as shown in FIG. 29, is obtained. In FIG. 28, three electron emitting devices 55, are arranged in parallel, thereby constituting an electron emission source 59.

With the above structure, the following advantages are obtained.

In the first to eleventh embodiments, the edge portions 25*a* of the gate electrodes are formed by making the through-holes 26 in the conductor film 25. In the twelfth embodiment, the edge portion 56 is formed without providing through-holes 26.

Specifically, in the first to eleventh embodiments, a circular through-hole 26 is formed in the conductor film 25 functioning as gate electrode so that an electric field can be effectively applied to the columnar crystal 28 located at the center of the through-hole 26. In the twelfth embodiment, however, such an advantage is not obtained.

The drawback in the case where the through-hole 26 is provided is that the degree of freedom of arrangement of the electron emitting devices 21 is considerably limited. A predetermined distance must be provided between the through-holes 26. In addition, the distance between the through-holes 26 must be set at a predetermined value or more, depending on the resolution of the exposing apparatus.

On the other hand, according to this embodiment, the shape of the edge portion 56 is not limited, if it has an edge portion 56. Thus, the degree of freedom of arrangement of electron emitting devices 55, 55' is increased.

Furthermore, according to this embodiment, like the electron emitting devices of the first to eleventh embodiments, the electron emission density can be remarkably increased, as compared to the conventional Spindt type electron emitting device. This advantage will now be described with reference to FIGS. 30A to 30C.

Figure 30A:
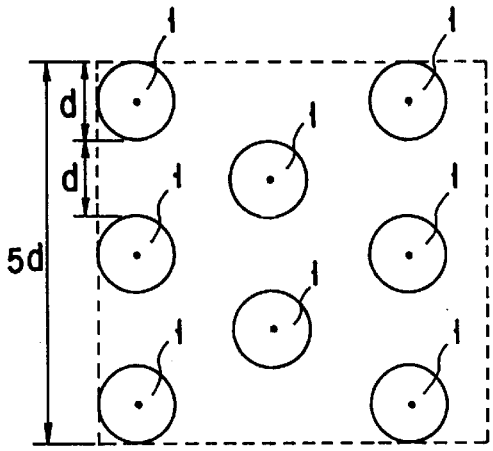
FIGS. 30A to 30C are views for explaining the electron emission density of the electron emitting device according to the twelfth embodiment.
Figure 30B:
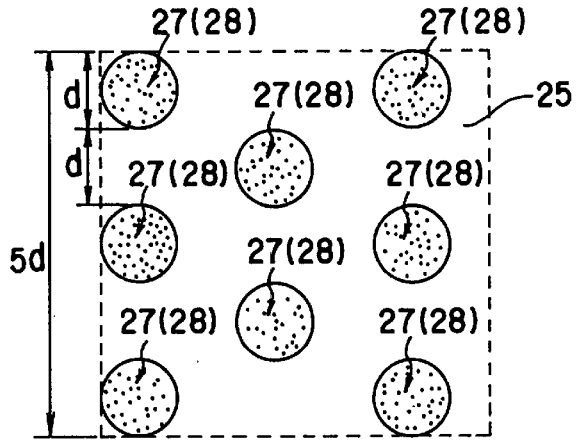
Figure 30C:
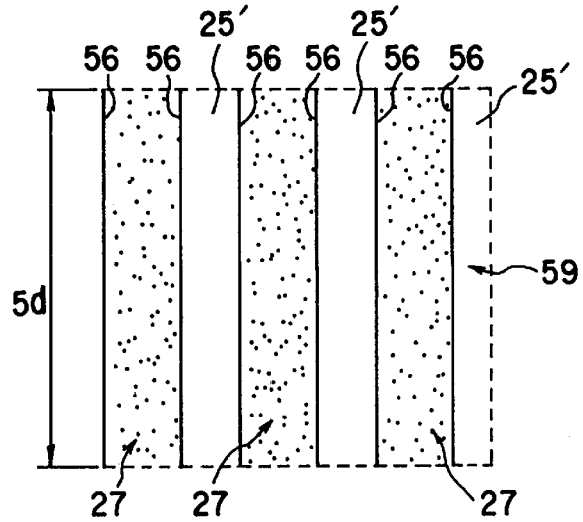

FIG. 30A shows a conventional Spindt type electron emitting device array (an integrated electron emitting device), FIG. 30B shows an electron emitting device array according to the eleventh embodiment, and FIG. 30C shows an electron emitting device array according to the twelfth embodiment.

Suppose a square area of 5d×5d, as shown in FIG. 30A (d=the diameter of each through-hole formed in a conductor film functioning as gate electrode). In the case of the Spindt type electron emitting device, since only one emitter electrode is provided for one through-hole (see FIG. 45), the number of emitter electrodes is 8. Accordingly, the number of electron emission points is 8.

In the case of the electron emitting device (FIG. 30B) according to the first to eleventh embodiments, electrons are emitted from almost all columnar crystals 28 of the columnar crystal mass 27 located within the through-hole 26. If the distance between upper end portions 28*a* of columnar crystals 28 is n, the number of columnar crystals located in each through-hole 26 is $\pi d^2/4n$. Thus, the number of electron emission points is $(\pi d^2/4n)\times 8$.

In the case of the twelfth embodiment (FIG. 31C), electrons are emitted from the columnar crystals 28 located along the linear edge portions 56. The number of columnar crystals 28 located near each edge portion 56 is 5d/n. Accordingly, the number of electron emission points is $(5d/n)\times 6$.

In any case, d>>n. Thus, according to the electron emitting source 59 of the twelfth embodiment, the number of emitter electrodes is much greater than that in the electron emission source (FIG. 30A) constituted by integrating conventional Spindt type electron emitting devices, and the electron emission efficiency is enhanced.

Figure 31:
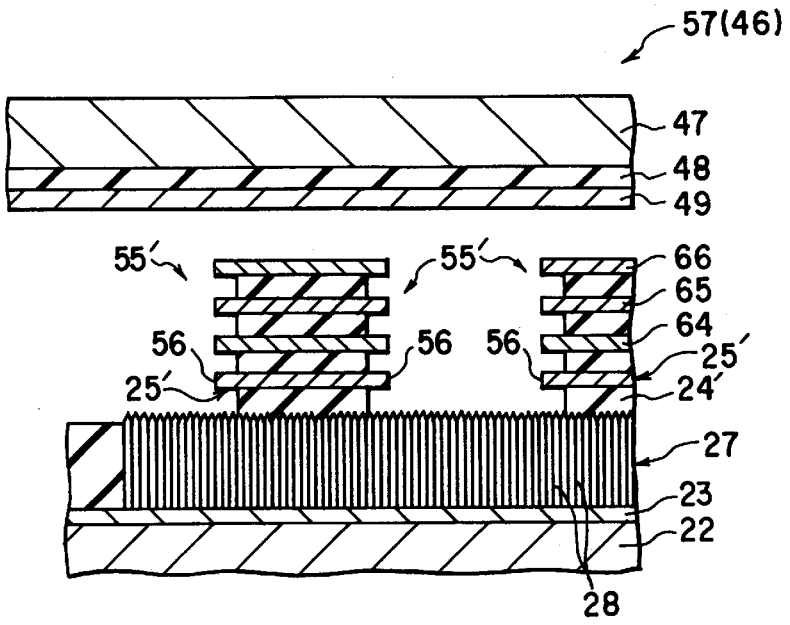
FIG. 31 is a vertical cross-sectional view showing an electron emission source according to a 13th embodiment of the invention.

A 13th embodiment of the invention will now be described with reference to FIG. 31.

In a field electron emission source 59 of the 13th embodiment, the conductor film 25' (gate electrode) of the electron emitting device 55, of the 12th embodiment shown in FIG. 28 is provided with a converging electrode 64, an acceleration electrode 65 and a deflecting electrode 66 via insulating layers 60 to 62.

In the first to eleventh embodiments, the through-hole 26 of the electron emitting device is circular, and the electric field can be concentrated at the central region of the through-hole 26. Thus, the locus of the emitted electrons is not broadened so much. However, the electron emitting device 55 of the 12th embodiment does not have the means for restricting the locus of electrons, and there is a possibility that the locus of electrons is broadened considerably.

In the present embodiment, in order to solve the above problem, the converging electrode 64, acceleration electrode 65 and deflecting electrode 66 each having an edge portion of the same shape as the edge portion 56 of the conductor film 25' are provided among the insulating layers 60 to 62 on the conductor film 25' (gate electrode). Thus, the locus of electrons emitted from the columnar crystal mass 27 is converged, the electrons are accelerated and, if necessary, the locus is deflected.

A manufacturing process for this electron emitting device is as follows. The conductors, which will become the gate electrode 25, converging electrode 64, acceleration electrode 65 and deflecting electrode 66, and insulators are alternately laminated on the columnar crystal mass 27 formed on the base electrode 23. The resultant structure is etched according to predetermined patterns, thereby forming edge portions (56) of the respective electrodes. Finally, the insulating layers alone are selectively etched by wet etching using HF, etc. in the intra-plane direction. Thus, the electron emitting device as shown in FIG. 31 is obtained.

A 14th embodiment of the invention will now be described with reference to FIG. 32. The structural elements common to those in the 12th embodiment are denoted by like reference numerals and a description thereof is omitted.

A electron emitting device 60 of the 14th embodiment is manufactured by the same method as with the electron emitting device 21 of the first embodiment, and the same advantage as with the electron emitting device 55 (FIG. 25) of the eleventh embodiment can be obtained.

An insulating film 24' and a conductor film 25' are formed on a base electrode 23 formed on the substrate 22. The insulating film 24' and conductor film 25 are etched according to a predetermined pattern and the surface of the base electrode 23 is exposed.

The columnar crystal mass 27 is selectively grown only on the surface of the base electrode 23. Finally, the insulating film 24' located around the columnar crystal mass 27 is etched back by means of wet etching using HF in the intra-plane direction. Thereby, the edge portion 56 of the conductor film 25 (gate electrode) is projected towards the crystal mass 27.

Figure 32:
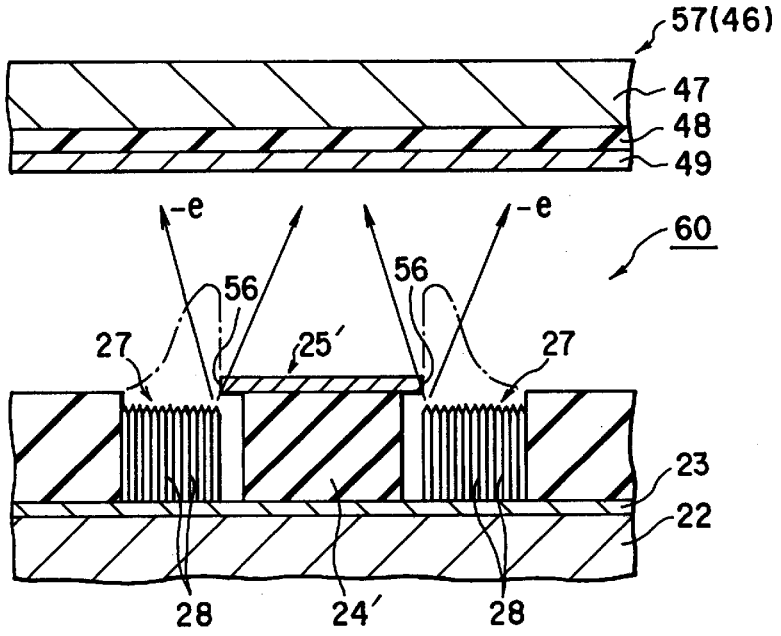
FIG. 32 is a cross-sectional view of an electron emitting device according to a 14th embodiment of the invention.

Thus, like the eleventh embodiment, the electron emitting device 60 shown in FIG. 32 is obtained, wherein the columnar crystal mass 27 extends outside the edge portion 56 of the conductor film 25'.

With this structure, the same advantage as with the 12th embodiment can be obtained. In addition, like the 13th embodiment, the locus of emitted electrons can be controlled by providing the converging electrode 64, acceleration electrode 65 and deflecting electrode 66.

Figure 33:
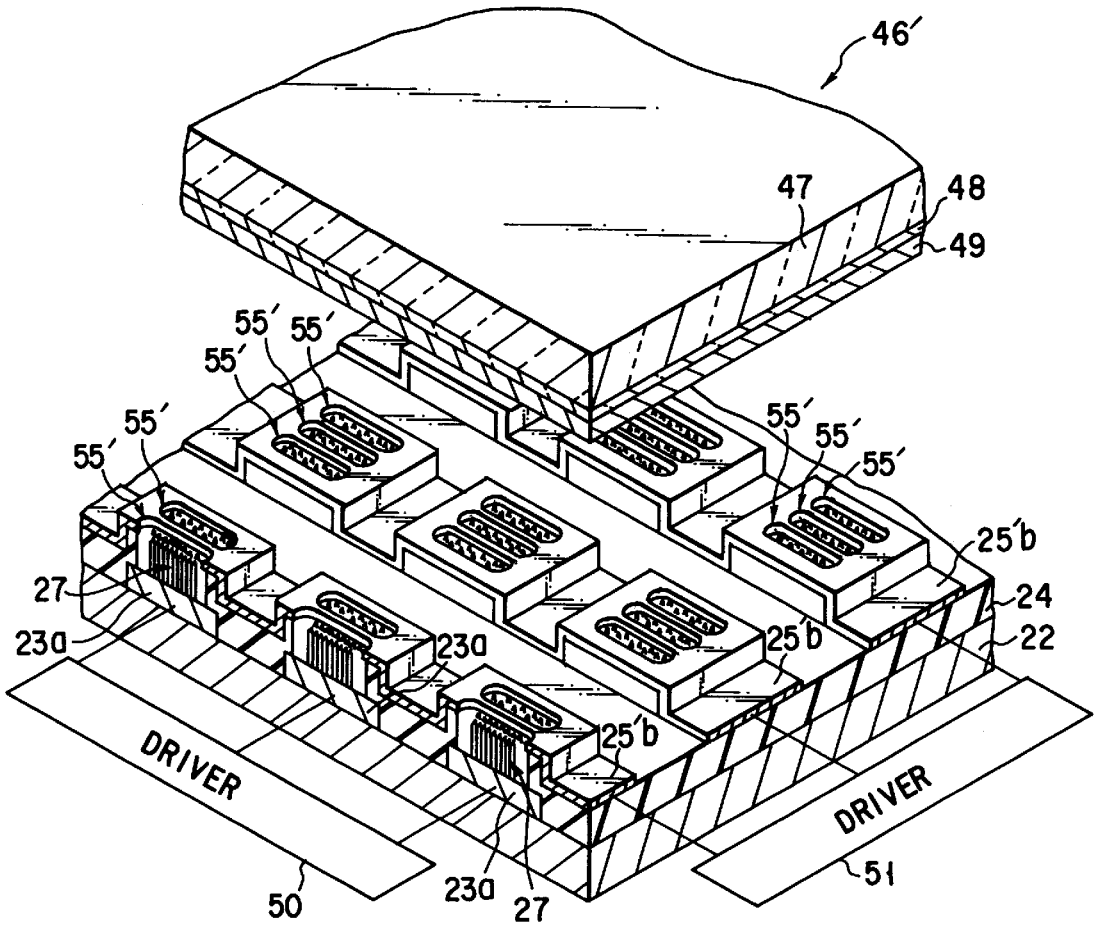
FIG. 33 is a perspective view showing a planar display apparatus according to a 15th embodiment of the invention.

FIG. 33 shows a planar display apparatus according to a 15th embodiment of the invention, in which the electron emitting device 55' of the 12th embodiment shown in FIG. 28 is applied.

Figure 22:
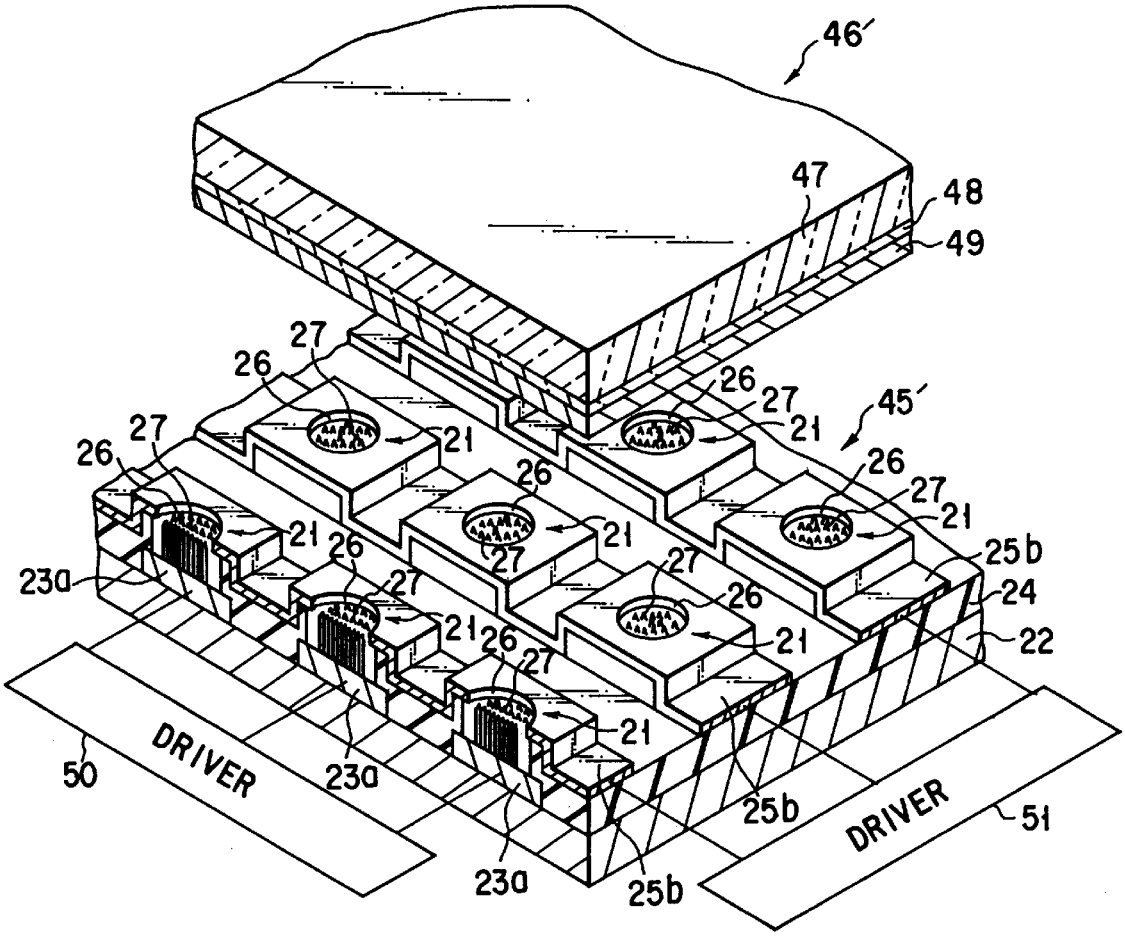
FIG. 22 is a perspective view of a planar display device according to a tenth embodiment of the invention.

In this planar display apparatus, one pixel of the planar display apparatus of the tenth embodiment shown in FIG. 22 is constituted by the electron emitting device 55' of the 12th embodiment shown in FIG. 28.

In this embodiment, edge portions 56 of the gate electrodes (conductor film 25') of the electron emitting device 55' are formed by cutting slits in three lines in each conductor film 25'*b* constituting the address line.

Figure 34:
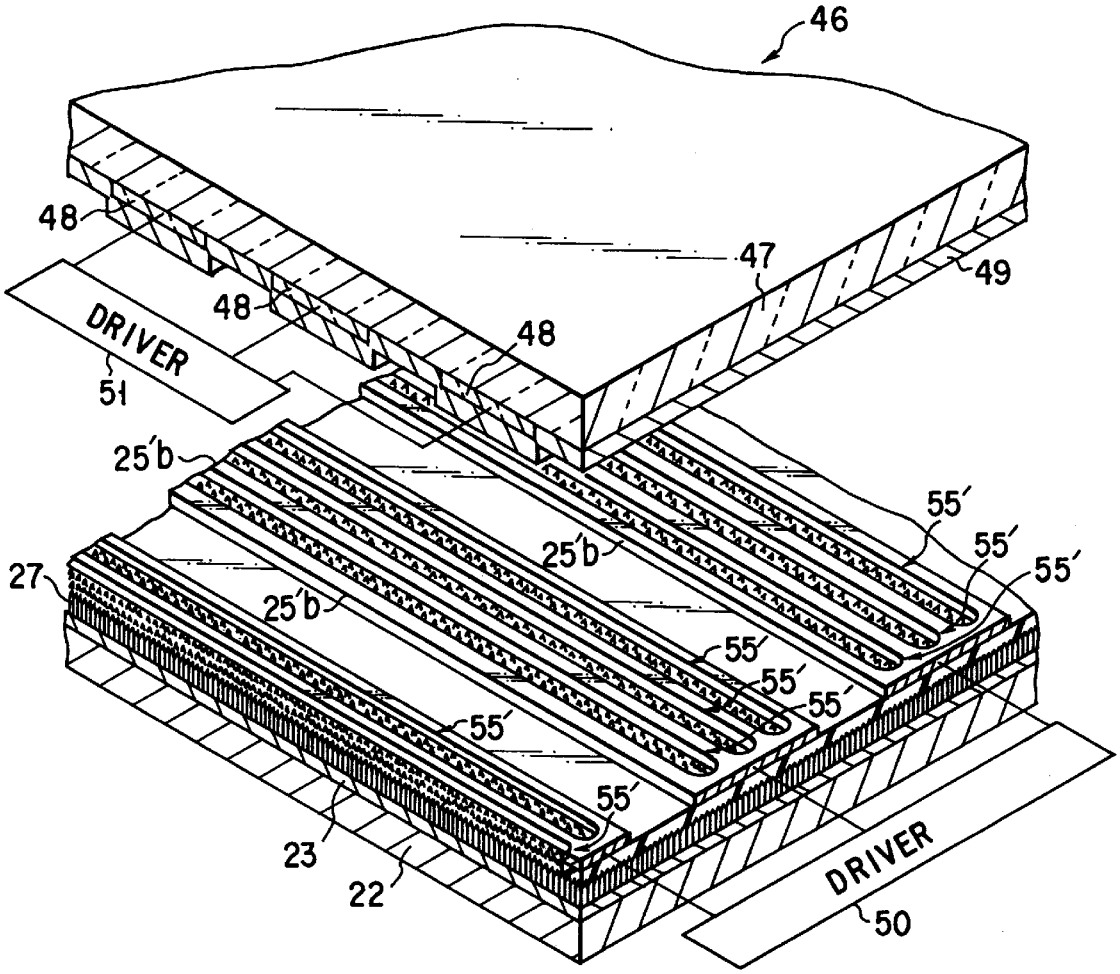
FIG. 34 is a perspective view showing a planar display apparatus according to a 16th embodiment of the invention.

FIG. 34 shows a planar display apparatus according to a 16th embodiment of the invention.

Figure 23:
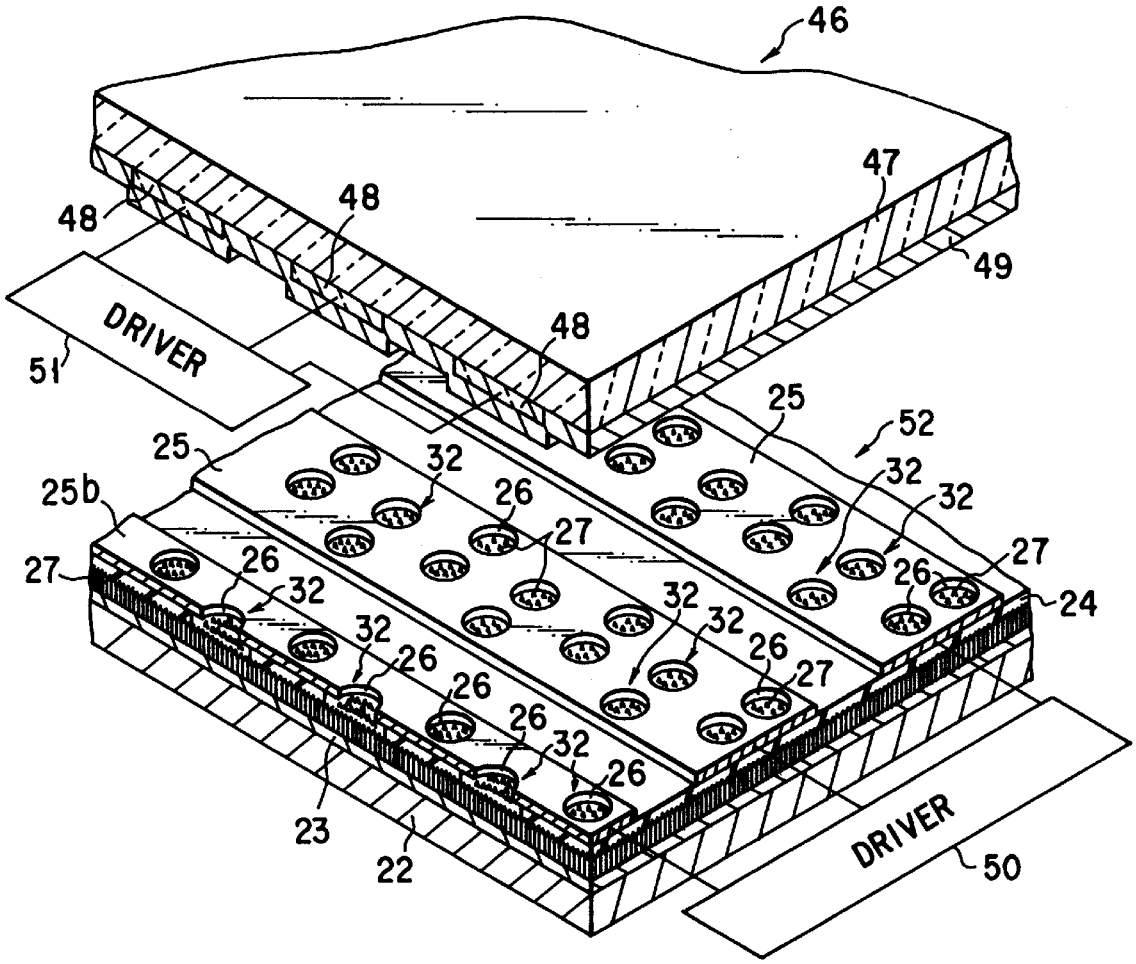
FIG. 23 is a perspective view of a planar display device according to an eleventh embodiment of the invention.

In the 16th embodiment, the conductor film 25'*b* constituting the address line of the planar display apparatus of the 12th embodiment shown in FIG. 23 is provided with three slits. Thus, straight edge portions 56 are formed, and the electron emitting device 55' of the eleventh embodiment shown in FIG. 28 is constituted.

In the planar display apparatuses of the 14th and 15th embodiments, it is considered that the locus of electrons emitted from each electron emitting device 55' is greatly broadened, as described above. Thus, as described in connection with the 13th embodiment, the locus of emitted electrons may be controlled by providing the converging electrode 64, acceleration electrode 65 and deflecting electrode 66 on the conductor film.

As has been described above, columnar crystal masses are used as emitter electrodes in the electron emitting devices according to the first to 16th embodiments.

According to the above structures, electron emitting devices, which can be easily manufactured and have a high electron emission coefficient, can be provided. These electron emitting devices are integrated to constitute electron emission sources or planar display apparatuses. Thus, these apparatuses can be well operated at low voltage.

According to the methods of manufacturing the electron emitting device of the present invention and the planar display apparatus to which the electron emitting device of this invention is applied, the emitter electrode can be formed by making use of the film formation technique alone. At the same time, the tip portion of the emitter electrode can be sharpened. Therefore, the above-described electron emitting device with high electron emission coefficient and the planar display apparatus in which the electron emitting devices are integrated can easily been manufactured.

A 17th embodiment of the invention will now be described with reference to FIGS. 35 to 39C.

Field electron emitting devices according to 17th and following embodiments are similar to the electron emitting devices according to the first to 16th embodiment in that columnar crystal masses are used as emitter electrodes. However, the former devices differ from the latter devices with respect to the type of electron extracting electrodes for extracting electrons from the columnar crystal masses (gate electrodes in the first to 16th embodiments).

Figure 35:
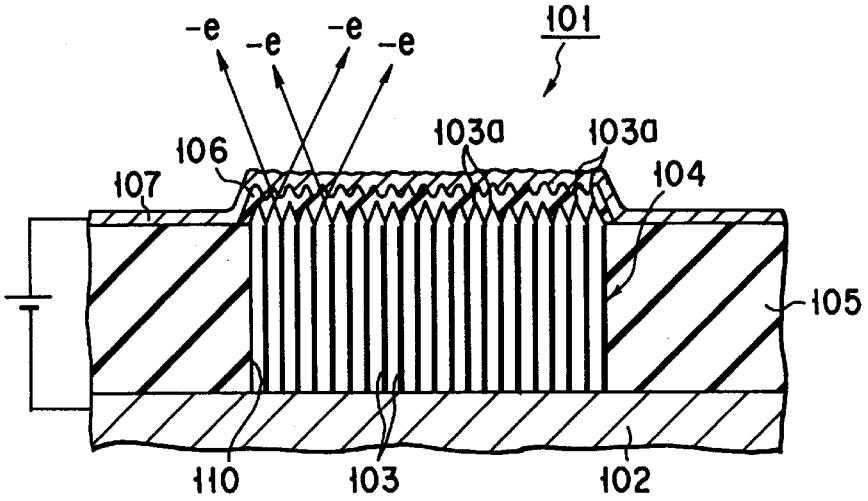
FIG. 35 is a vertical cross-sectional view of an electron emitting device according to a 17th embodiment of the invention.
Figure 36:
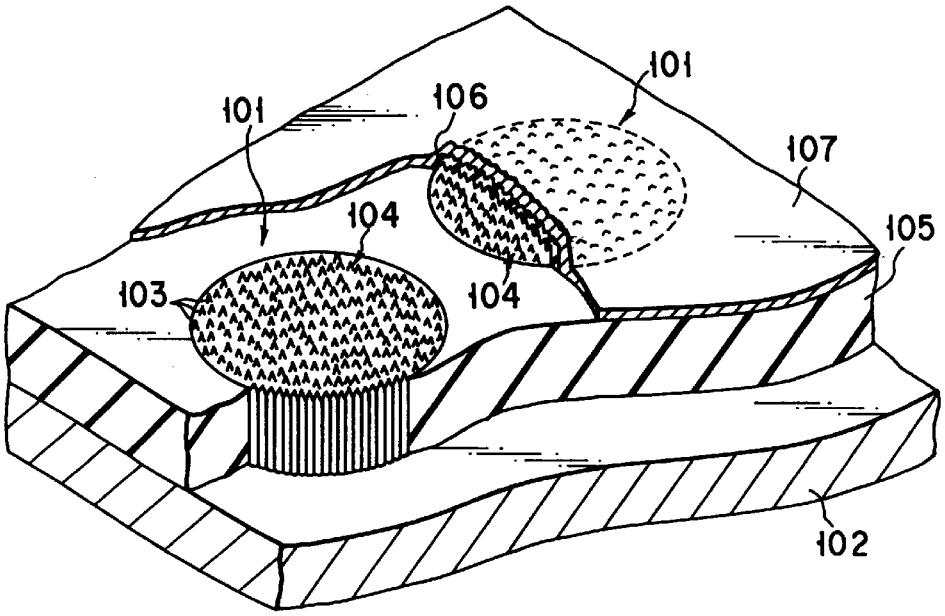
FIG. 36 is a perspective view of the electron emitting device according to the 17th embodiment of the invention.

FIGS. 35 and 36 schematically show the structure of the electron emitting device 101 according to the 17th embodiment.

Numeral 102 denotes an electrically conductive substrate (conductor). A columnar crystal mass 104 consisting of many fine columnar crystals 103 with sharpened upper end portions 103*a* is formed on the substrate 102. An insulating layer 105 is formed on that portion of the substrate 102, which surrounds the columnar crystal mass 104. An insulating film 106 and a conductiver film 107 are laminated in this order on the crystal mass 104 and insulating layer 105.

An electrically conductive material, i.e. a metal or a semiconductor such as Si (silicon), is used as material of the substrate 102. The columnar crystal mass 104 is, for example, a mass of tungsten crystals formed by CVD (Chemical Vapor Deposition), as will be describer later. By performing the CVD under predetermined condition, the columnar crystals 103 with sharpened upper end portions 103*a* are grown vertically to the surface of the substrate 102. Such columnar crystals 103 contain, e.g. β-W (β-phase tungsten). As mentioned above, FIGS. 5A and 5B are SEM photographs showing the crystalline structure of the columnar crystal mass 104 (columnar crystals 103).

In addition, $SiO_2$, for example, may be used as material of the insulating layer 105, a thermal oxide film of tungsten, for example, may be used as the insulating film 106, and a general conductive metal, e.g. Cu or Al, may be used as material of the conductor film 107.

The operation of the electron emitting device 101 will now be described.

The columnar crystal mass 104 has electrical conductivity and is electrically connected to the substrate 102.

For example, if a negative voltage is applied to the substrate 102 and a positive voltage is applied to the conductor film 107, thereby causing a potential difference between the crystal mass 104 and conductor film 107, an electric field is applied to the crystal mass 104 via a gap defined by the thickness of the insulating film 106.

The applied electric field is concentrated at the needle-like upper end portion 103*a* of each columnar crystal 103. Thus, electrons (−e) are extracted from the upper end portion 103*a* of each columnar crystal 103 into the insulating film 106 by a quantum-mechanical tunneling phenomenon. Specifically, each columnar crystal 103 (columnar crystal mass 104) functions as an emitter electrode, and the conductor film 107 functions as an electron extraction electrode.

As is shown in FIG. 35, the extracted electrons (−e) are discharged to the vacuum above the electron emitting device 101 through the thin insulating film 106 and conductor film 107. In this case, if an anode electrode (not shown) to which a voltage is applied is situated at a location facing the electron emitting device 101, the discharged electrons are attracted to the anode electrode.

The electron emitting device 101 has a so-called MIM (Metal-Insulater-Metal) lamination structure consisting of a metal (tungsten:columnar crystal mass 104)—insulating layer 106 (oxide layer of tungsten)—a metal (conductor film 107). Since electrons are emitted from many densely arranged fine columnar crystals 103, the electron emitting device functions as a planar electron beam emission source.

A process for manufacturing the electron emitting device 101 will now be described with reference to FIGS. 37A to 37E.

Figure 37A:
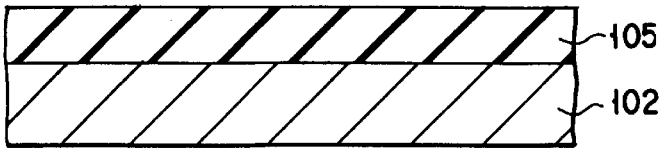
FIGS. 37A to 37E show the steps of a process for manufacturing the electron emitting device according to the 17th embodiment of the invention.
Figure 37B:
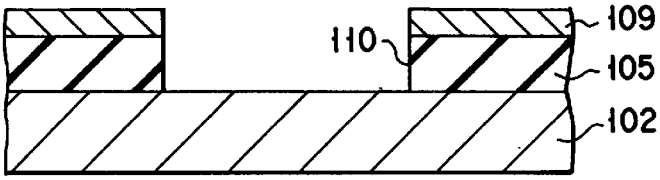

At first, as shown in FIG. 37A, an insulating layer 105 is formed on a substrate 102 by means of thermal oxidation, sputtering or CVD. A resist 109 is coated on the insulating film 105 and is patterned. The pattern of the resist 109 may have a desired shape such as a circular shape or a square shape in accordance with the region where a columnar crystal mass 104 is to be formed. Using the resist 109 as a mask, anisotropic etching such as RIE is performed. Thus, a through-hole 110 is formed in the insulating layer 105, as shown in FIG. 37B.

Figure 37C:
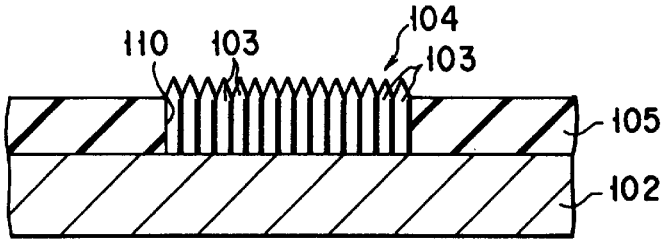

After the resist 109 is washed and removed, the columnar crystal mass 104 is formed on that surface portion of the substrate 102 which is exposed to the through-hole 110, as shown in FIG. 37C.

The formation of the crystal mass 104 is performed by means of, e.g. CVD, as described above.

Specifically, the substrate 102 is held within a reduced-pressure chamber (not shown), and the temperature within the chamber (i.e. ambient temperature in a surrounding region of the substrate) is set at 120° C. to 500° C., preferably about 320° C. (see FIGS. 7A to 7C).

Then, two reaction gases, $WF_6$ (tungsten hexafluoride) and $SiH_4$ (silane) are introduced into the chamber and are reacted. The flow ratio of the two reaction gases ($SiH_4/WF_6$) is set at 0.9 to 2.0, preferably 1.0.

Thus, a tungsten (W) film is formed on the surface of the substrate 102. Since no free electrons are present on the insulating layer 105, no film is formed thereon. Accordingly, the columnar crystal mass 104 can be selectively formed in the through-hole 110 alone.

It was confirmed by experiments that it is preferable to introduce hydrogen gas as inert gas into the chamber in order to control the pressure therein, when the columnar crystal mass 104 is selectively formed in the through-hole 110 alone. It was also confirmed that the flow ratio of the hydrogen gas should desirably be 25 or more when $SiH_4/WF_6$=1.0.

In addition, it was confirmed that each crystal of tungsten grown in the above-mentioned atmosphere contains β-W (β-phase tungsten) and each crystal is vertically grown from the surface of the substrate 102 in a columnar shape (columnar crystal 103). The upper end portion 103*a* of each columnar crystal is sharpened, like a needle.

The density of arrangement of columnar crystals 103 can be freely set according to film formation conditions. Under the conditions of this embodiment, the pitch of arrangement can be set to a very small value in the range of 0.1 μm to 0.5 μm.

The height of the columnar crystal mass 104 can be set by controlling the time for CVD. In this embodiment, the crystal mass 104 is grown up to a level slightly higher than the upper surface of the insulating layer 105.

Figure 37D:
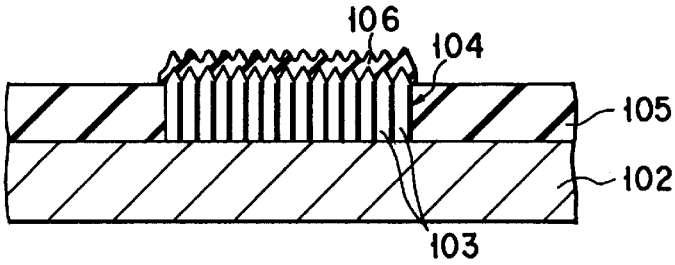

After the columnar crystal mass 104 is formed, the temperature within the chamber is set, for example, in the range of 300 to 400° C. and a small amount of oxygen (degree of vacuum: several mTorr) is introduced. Thus, as shown in FIG. 37D, an insulating film 106 or a thin tungsten oxide film having a thickness of 100 Å or less is formed on the surface of the columnar crystal mass 104.

The insulating film 106 is coated on the surfaces of the sharpened upper end portions of the columnar crystals 103 to a substantially uniform thickness. Accordingly, the insulating film 106 is formed unevenly in accordance with the shapes of the upper end portions 103*a* of crystals 103.

Figure 37E:
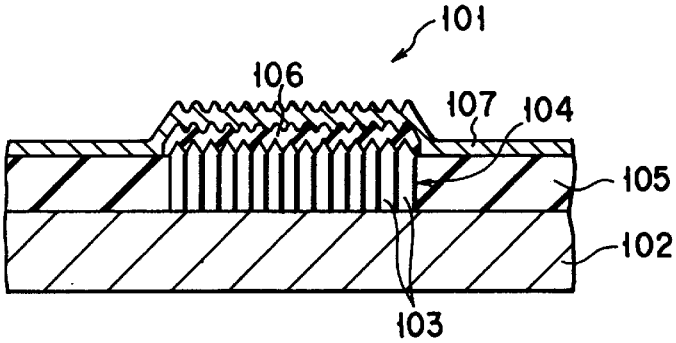

In the final step, a thin conductor film 107 is coated on the surfaces of the insulating film 105 and insulating film 106 by means of, e.g. sputtering. Thus, an electron emitting device 101 shown in FIG. 37E is obtained.

Figure 38A:
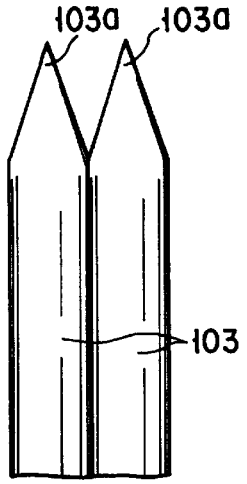
FIGS. 38A to 38C are enlarged vertical cross-sectional views of a tip portion of an emitter electrode of the electron emitting device according to the 17th embodiment.
Figure 38B:
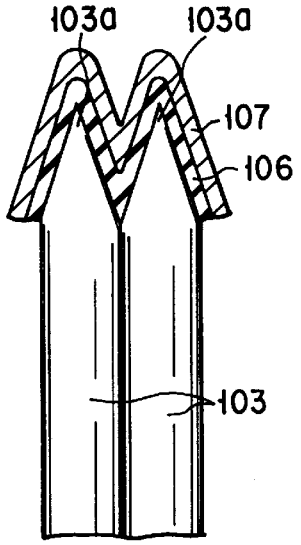
Figure 38C:
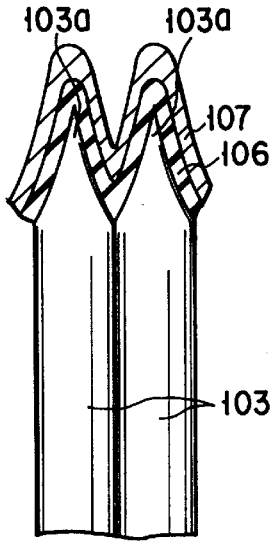

FIGS. 38A to 38C are enlarged views of the upper end portion 103*a* of the columnar crystal 103.

When the upper end portion 103*a* of columnar crystal 103 has been formed by CVD, it is sharpened, as shown in FIG. 38A. The insulating film 106 and conductor film 107 are coated along the sharpened configuration of the upper end portion 103*a,* as shown in FIG. 38B.

After the insulating film 106 and conductor film 107 have been formed and the electron emitting device 101 has been cooled to normal temperature, the side faces of the upper end portion 103*a* of columnar crystal 103 are curbed inwards by a remaining stress, as shown in FIG. 38C. It was confirmed that the degree of sharpness of the uppermost end portion was thus increased.

The above-described electron emitting device 101 has special advantages which cannot be obtained with a conventional MIM type electron emitting device.

According to the conventional MIM type electron emitting device, a conductor with a substantially flat surface is used as an emitter electrode, and an insulating film and a conductor film (electron extracting electrode) are laminated on the surface of the conductor.

A potential difference is provided between the conductor film and emitter electrode and a voltage is applied to the emitter electrode from the conductor film via a gap defined by the insulating film. Thus, electrons are extracted from the emitter electrode by a quantum-mechanical tunneling phenomenon. The conventional MIM type electron emitting device functions as a planar electron beam emission source.

In the field electron emission device, the electron emission efficiency (emission current density) is determined by the distance between the emitter electrode and electron extraction electrode (conductor film), or a geometrical quantity such as the degree of electric field concentrated on the emitter electrode. The electron emission efficiency increases as the distance between the emitter electrode and electron extraction electrode decreases or as the degree of sharpness of the emitter electrode increases.

In the above-described conventional MIM type device, the surface of the emitter electrode is substantially flattened so that the MIM type device can function as a planar electron beam emission source. Thus, the electron emission efficiency thereof is determined by the thickness of the insulating film. It is therefore necessary to reduce the thickness of the insulating film as much as possible. However, since it is necessary that this insulating film have no lattice defect, the reduction in film thickness is very difficult.

By contrast, in the present invention, attention is paid to the fact that the mass 104 of columnar crystals 103 with sharpened tip portions 103*a* is obtained by film formation techniques such as CVD under predetermined conditions. The mass 104 is used as an emitter electrode of the MIM type electron emitting device. Thus, the following advantages can be obtained.

First, since the degree of concentration of an electric field is improved, the electron emission efficiency can be enhanced without greatly decreasing the thickness of the insulating film.

Specifically, in the conventional MIM type device, since the surface of the emitter electrode is substantially flat, the advantage of concentration of electric field cannot be obtained. However, in the present invention, the emitter electrode is constituted by the mass 104 of columnar crystals 103 with needle-like sharpened tip portions 103*a*. Therefore, an electric field can be concentrated at the tip end portions 103*a* of the columnar crystals 103.

In addition, since the conductor film 107 functioning as electron extraction electrode is formed to cover the sharpened upper end portions of the columnar crystals 103, the degree of concentration of electric field is further increased. The reason for this will now be described with reference to FIGS. 39A to 39C.

Figure 39A:
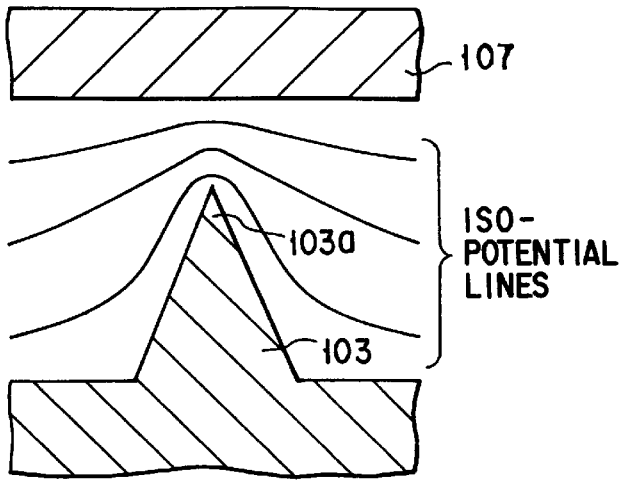
FIGS. 39A to 39C are views for explaining the degree of concentration of an electric field at the emitter electrode of the electron emitting device according to the 17th embodiment.
Figure 39B:
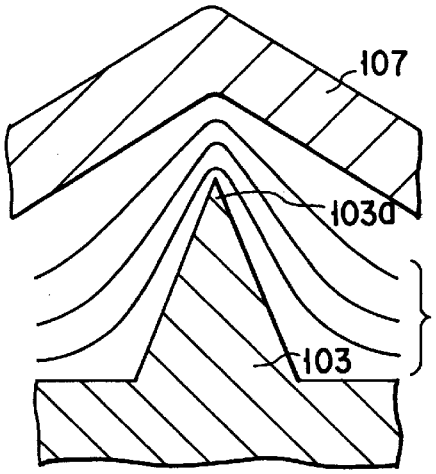
Figure 39C:
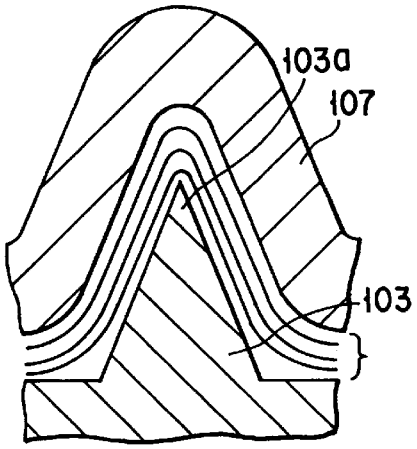

FIGS. 39A to 39C show three shapes of the conductor film 107. The degrees of concentration of electric field, which are obtained with these shapes, are compared. With these three shapes, iso-potential distributions are shown by iso-potential lines in the figures. The field concentration coefficient increases quickly at the upper end portion 103*a*, as indicated by the iso-potential lines.

Accordingly, if the conductor film 107 is formed so as to cover the tip portion 103*a* of columnar crystal 103 (as in the present embodiment), as shown in FIG. 39C, the degree of concentration of electric field is highest.

As described above, since the side faces of the needle-like upper end portion 103*a* are curved inward by the remaining stress in the insulating film 106 (FIG. 38C), the degree of sharpness further increases. Thus, the iso-potential lines become steeper and the degree of field concentration increases.

Since the degree of field concentration increases, the electron emission efficiency can be enhanced without greatly decreasing the thickness of the insulating film 106. Thus, electrons can be emitted with a low operational voltage.

In the columnar crystal mass 104 containing β-W, the interval of tip portions 103*a* of columnar crystals 103 is 0.1 μm or less and is very small. Thus, the electron emission density is high and the crystal mass 104 functions as planar electron beam emission source very well.

Secondly, the manufacture of this electron emitting device is very easy.

According to the present invention, the sharpened fine columnar crystals 103 (emitter electrodes) can be formed at high density, and the electron emitting device functioning as planar electron beam emission source can be manufactured very easily.

There is a conventional electron emitting device having sharpened emitter electrodes, like a Spindt type device or a planar type device. These are manufactured through complex sharpening steps. Besides, the density of arrangement of emitter electrodes cannot be increased since it is limited by the resolution of patterning. Consequently, the conventional device cannot be used as planar electron emission source, like an MIM type device.

However, according to the electron emitting device of the present invention, the densely integrated, finely sharpened emitter electrodes (columnar crystal mass 104, columnar crystals 103) can be obtained. There is no need to perform complex steps for sharpening or to use a high-resolution apparatus. Thus, the electron emitting device 101 with high electron emission efficiency can be easily obtained.

Since high patterning resolution is not required, as mentioned above, it is possible to use a relatively low-resolution apparatus employed in a process of manufacturing a conventional LCD (liquid crystal display), without using a high-resolution apparatus for a semiconductor manufacturing process. Therefore, a high-performance electron emitting device can be manufactured at low cost.

Thirdly, the columnar crystals 103 can be formed selectively on only the substance containing free electrons (substrate 102 in the embodiment) by CVD. Thus, only by varying the patterning of the insulating layer 105, can the emitter electrode be formed on a desired area of the substrate 102. Therefore, many electron emitting devices can be easily integrated on a single substrate in an array.

In the first embodiment, CVD is performed to deposit the columnar crystals 103 on the first conductor film. However, in the present invention, CVD may be replaced with sputtering, etc.

Although the β-W containing material is used for the columnar crystals 103, the material is not limited if the columnar crystals 103 are obtained. For example, Al may be used as material of columnar crystals 103. In this case, too, CVD or sputtering may be performed to deposit columnar crystals.

In the present embodiment, the flow ratio ($SiH_4/WF_6$) of the reaction gases is set at 1.0 (1:1). However, the flow ratio of reaction gases may be freely chosen if desired columnar crystals are obtained. Furthermore, the ambient temperature within the chamber can be varied.

An 18th embodiment of the invention will now be described with reference to FIGS. 40 and 41A to 41F. The structural elements common to those in the 17th embodiment are denoted by like reference numerals, and a description thereof is omitted.

Figure 40:
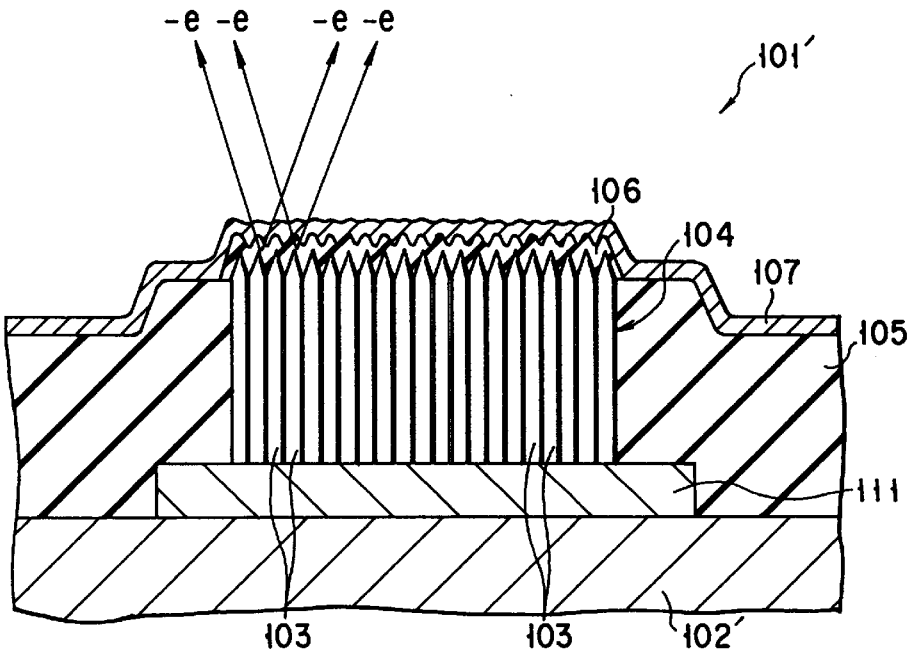
FIG. 40 is a vertical cross-sectional view showing an electron emitting device according to a 18th embodiment of the invention.

FIG. 40 shows a electron emitting device 101' according to the 18th embodiment, which differs from the first embodiment in that a base electrode 111 is formed on a substrate 102'.

In the case where an insulating material such as glass is used as substrate 102', the base electrode 111 needs to be provided on the substrate (conductor) in order to supply power to the columnar crystal mass 104.

FIGS. 41A to 41F illustrate a process manufacturing the electron emitting device including the base electrode 111.

Figure 41A:
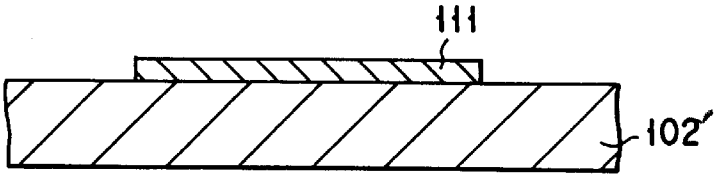
FIGS. 41A to 41F show the steps of a process for manufacturing the electron emitting device according to the 18th embodiment of the invention.
Figure 41B:
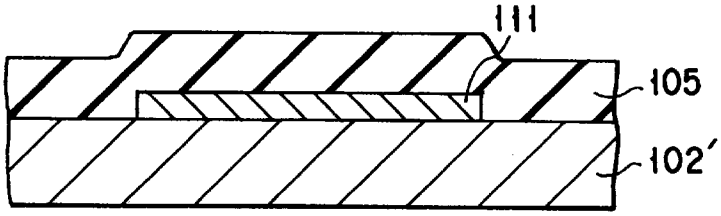
Figure 41C:
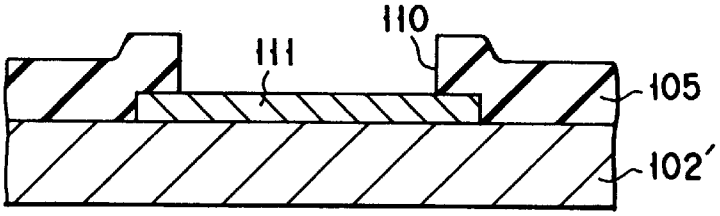
Figure 41D:
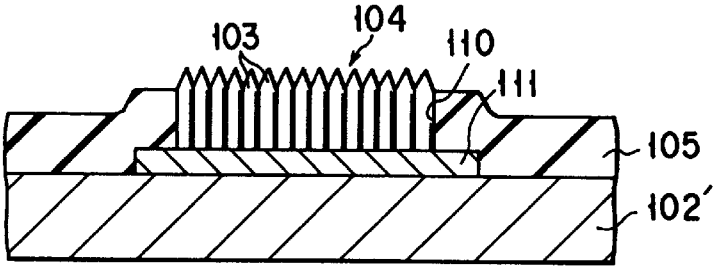
Figure 41E:
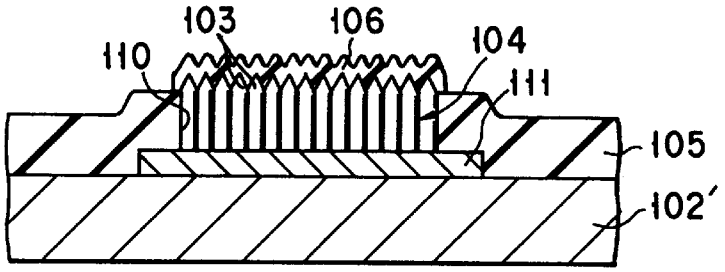
Figure 41F:
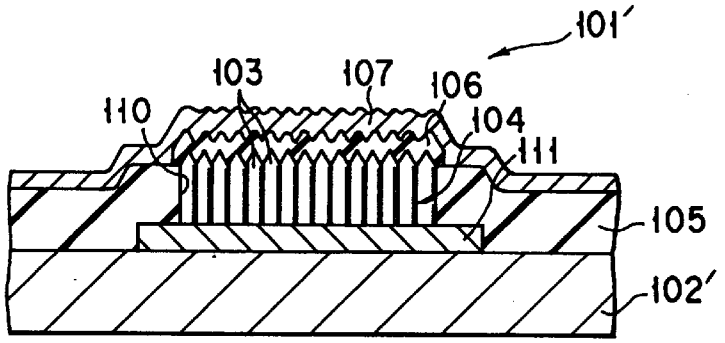

As is shown in FIG. 41A, the base electrode 111 is formed on the substrate 102' (e.g. glass substrate).

When the base electrode 111 is formed, the surface of the substrate 102' is coated with a metal such as Al r Cu by means of sputtering, etc. Then, the coating metal film is etched into a desired shape, e.g. a square shape or a circular shape. Thus, the base electrode 111 is obtained.

Subsequently, the same steps as in the 17th embodiment (FIGS. 37A to 37E) are carried out, as shown in FIGS. 41B to 41F. Thus, the electron emitting device 101', as shown in FIG. 40, can be obtained.

In this structure, the base electrode 111 is electrically connected to the columnar crystal mass 104. Thus, electrons can be emitted from the upper end portion 103*a* of each columnar crystal 103 of the columnar crystal mass 104, by applying a potential difference between the base electrode 111 and conductor film 107 (electron extraction electrode). Therefore, the same advantages as with the 17th embodiment can be obtained.

Each of the 17th and 18th embodiments relates to single electron emitting device 101, 101'. However, when the electron emitting device is actually used, many electron emitting devices are integrated on a single substrate such as a silicon wafer or a glass plate. If necessary, an anode is situated to face the electron emitting device so that a triode is obtained.

There are various uses of such an MIM type electron emitting device. For example, this device can be applied to a planar display apparatus, as in a 19th embodiment of the invention described below.

Figure 42:
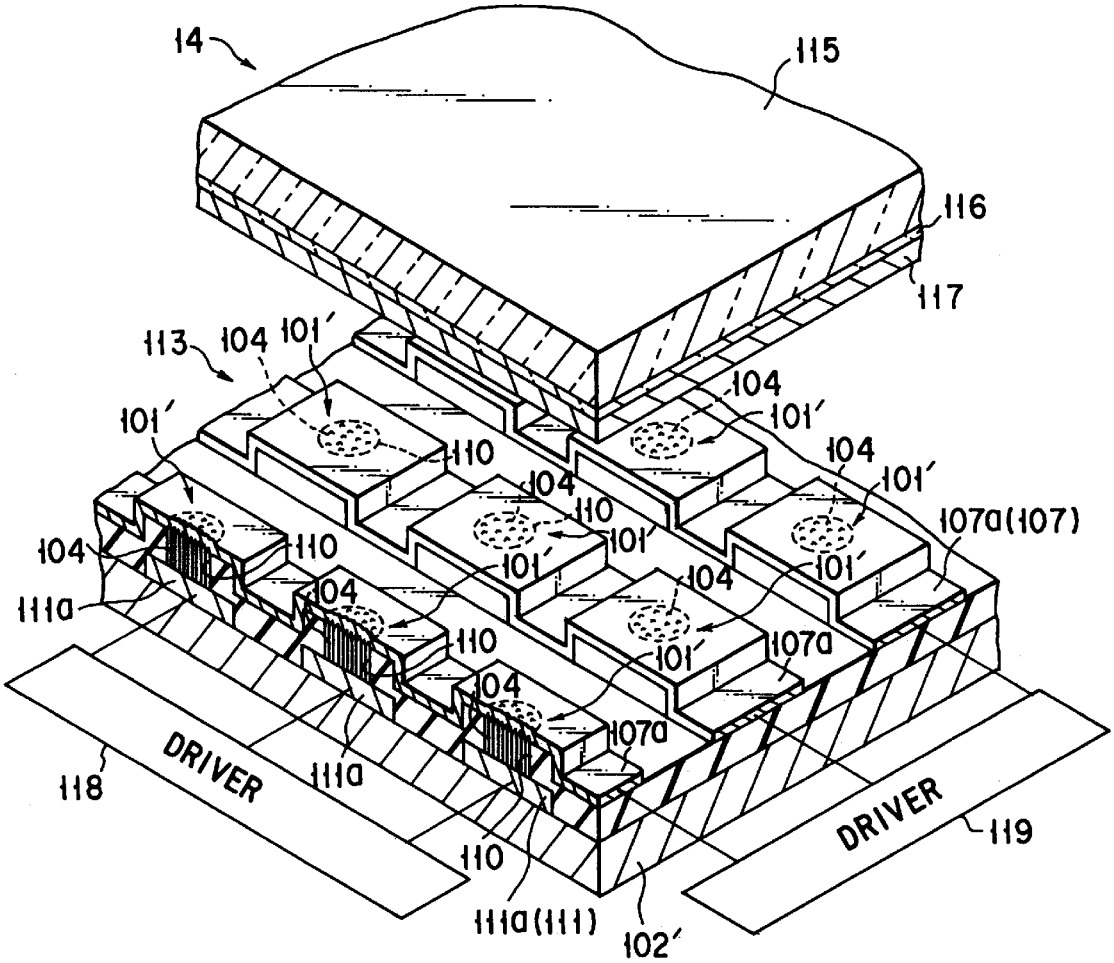
FIG. 42 is a perspective view showing a planar display device according to a 19th embodiment of the invention.

FIG. 42 shows the planar display apparatus according to the 19th embodiment. This apparatus comprises an electron emission source 113 formed by integrating electron emitting devices 101' of the 18th embodiment, and a display unit 114 which receives electrons emitted from the electron emission source 113 and emits lights for display.

The electron emission source 113 is manufactured in the following manner.

A base electrode 111 formed on the substrate 102 is divided by etching into many strip-like base electrodes 111*a* which are adjacent to one another in an x-direction. Thus, address lines are formed.

Then, an insulating layer 105 is formed on the substrate 102, and through-holes 110 are formed on the strip-like base electrodes 111*a* at predetermined intervals. Then, the aforementioned CVD is performed to form columnar crystal masses 104 on the base electrodes 111*a* exposed in the through-holes 110.

Thus, the columnar crystal masses 104 functioning as emitter electrodes are arranged on the substrate 102 in a matrix. In the case where CVD is adopted, no columnar crystal mass 104 is formed on areas where the base electrodes 111*a* are not exposed (i.e. areas excluding the through-holes 110).

Subsequently, by supplying a small amount of oxygen into the chamber, insulating films 106 (not shown in FIG. 42; see FIG. 41) made of a tungsten oxide film are formed on the surfaces of the columnar crystal masses 104. A conductor film 107 is then coated over the entire surfaces of the insulating films 106 and insulating film 105. The conductor film 107 is divided by means of etching, etc. into many conductor films 107*a* extending perpendicular to the base electrodes 111*a*. Thus, data lines are formed.

Through the above steps, the electronic emission source 113 in which many electron emitting devices 101' are integrated in a matrix is obtained.

On the other hand, the display unit 114 comprises a transparent substrate (quartz glass, etc.) 115, a transparent conductor film 116 (anode electrode) coated on that surface of the transparent substrate 115, which faces the electron emission source, and a multi-color light emission phosphor 117 coated on the surface of the transparent conductor film 116.

In this embodiment, an ITO (Indium Tin Oxide) film, for example, is used as transparent conductor film 116. The ITO film is an indium oxide film doped with tin oxide, and has both electrical conductivity and light transmission properties.

The multi-color light emission phosphor 117 is a phosphor for low-acceleration electron beams and is, for example, ZnO:Zn.

The display unit 114 and electron emission source 113 are coupled to each other at edge portions (not shown). The coupling is effected, for example, by making use of electrostatic bonding in a vacuum atmosphere. The space interposed between the display unit and electron emission source 113 is kept in a vacuum.

In the planar display apparatus having the above structure, each electron emitting device 101' constitutes one pixel of the planar display apparatus. In this planar display apparatus, the same driving method as is employed for an active matrix type liquid crystal display apparatus using TFTs can be adopted.

Specifically, the address lines constituted by the base electrodes 111*a* and the data lines constituted by the conductor films 107*a* are connected to drivers 118 and 119, respectively.

The drivers 118 and 119 are activated to apply a voltage to selected address and data lines. Thus, electrons are emitted from the electron emitting device 101' provided at an intersection of the selected lines.

In this case, if a voltage higher than a voltage, which has been applied to the conductor films 107*a,* is applied to the transparent conductor film 116 provided in the display unit 114, almost all emitted electrons are attracted to the transparent conductor film 116 and collide with the phosphor 117 coated on the surface of the transparent conductor film 116. Thus, the phosphor 117 emits light.

According to this planar display apparatus, the following advantages can be obtained.

First, a planar display apparatus functioning very well with a low operating power can be obtained.

Specifically, the electron emitting device 101' of the present invention is a planar electron beam emission source with very high electron emission efficiency. Thus, if the electron emission source 113 of the planar display apparatus is constituted by integrating the electron emitting devices at high density, it is possible to obtain a planar display apparatus which functions well with a low operating power.

In the present invention, as described above, a sharpened emitter electrode is obtained by making use of the shapes of crystals of the columnar crystal mass 104. Thus, the emitter electrode can be formed more easily with less defects. Thus, the yield of planar display apparatuses can be increased.

Secondly, the pixels of the planar display apparatus can be arranged at very high density.

Specifically, in this planar display apparatus, even if the electron emitting devices 101' constituting individual pixels are arranged close to each other, no problem arises if the distance between the electron emitting devices 101' is greater than the distance between the emitter electrode (upper end portion of columnar crystal mass 104) and the electron extraction electrode (conductor film 107*a*).

In the case of the MIM type electron emitting device of the present invention, the distance between the emitter electrode (4) and electron extraction electrode (7*a*) is determined by the thickness of the insulating film 106 and this thickness is 100 Å or less and very small. In addition, since the tip end portion of each emitter electrode is sharpened, the degree of field concentration is very high.

Thus, such a problem as crosstalk does not arise, even if the pixels are arranged at high density by decreasing the distance between the electron emitting devices 101', and the address lines and data lines are formed on the side of the electron emission source 113, as mentioned above.

Figure 43:
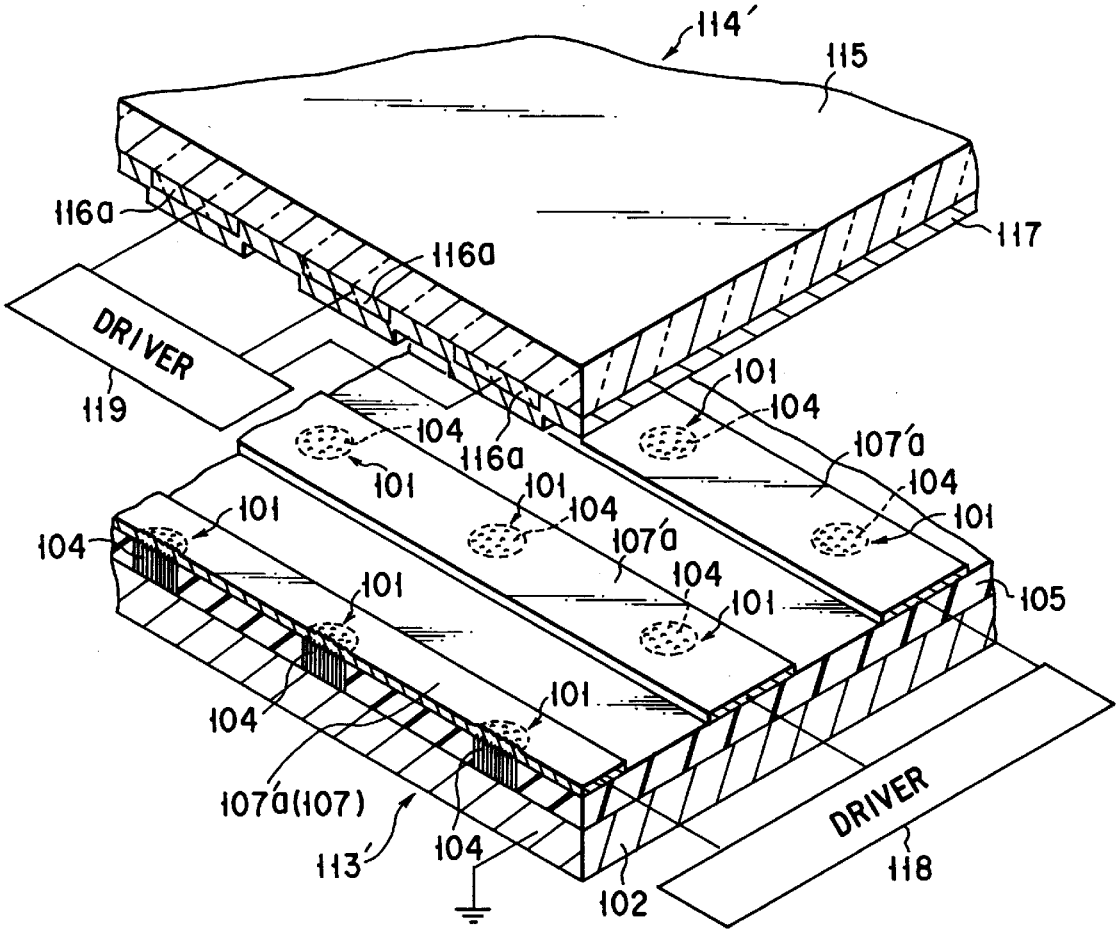
FIG. 43 is a perspective view showing a planar display device according to a 20th embodiment of the invention.

A planar display apparatus according to a 20th embodiment of the invention will now be described with reference to FIG. 43.

In the planar display apparatus of the 20th embodiment, the electron emitting devices 101 of the first embodiment are used as electron emitting devices used as an electron emission source and data lines are provided on the display (114') side.

Specifically, in the electron emission source 113' of the planar display apparatus, a conductor material (silicon wafer, etc.) is used for substrate 102. An insulating layer 105 is provided on the substrate 102, and through-holes 110 are formed in the insulating layer 105 in a matrix. Then, CVD is performed columnar crystal masses 104 functioning as emitter electrodes on the surface portions of the substrate 102 exposed in the through-holes 110.

After insulating films 106, which are thermal oxide films, are provided on the surfaces of the columnar crystal masses 104, a conductor film 107 is coated on the entire surface of the electron emission source 113'. The conductor film 107 is divided into a plurality of strip-like conductor films 107*a*' by means of etching. Thus, address lines are formed.

Specifically, in this embodiment, the conductor films 107*a* used as data lines in the third embodiment are used as address lines.

On the other hand, in the display unit 114', a transparent conductor film 116 of ITO is coated on the emission source (113')-side surface of a transparent substrate 115 of quartz glass. Then, the transparent conductor film 116 is divided into a plurality of strip-like transparent conductor films 116*a* extending perpendicular to the strip-like conductor films 107*a* of the electron emission source 113'. Thus, data lines are formed.

A multi-color light emission phosphor 117 is coated on the entire surface of the display unit. Thus, the manufacture of the display unit 114' is completed.

Thereafter, like the 19th embodiment, the display unit 114' and electron emission source 113' are bonded to each other with a predetermined gap interposed. This bonding is effected, for example, by electrostatic bonding in a vacuum atmosphere.

Thus, the planar display apparatus of the 20th embodiment is completely manufactured.

In this planar display apparatus, the address lines constituted by the conductor films 107*a* of electron emission source 113' and the data lines constituted by the transparent conductor films 116*a* of display unit 114' are connected to drivers 118 and 119 and are driven, for example, by the same method as is employed for a simple matrix type liquid crystal display apparatus.

In this case, if no voltage is applied to the substrate 102 and the substrate 102 is set at a ground potential (0 V), electrons are emitted from a selected one of the electron emitting devices 101 by a potential difference between the substrate 102 and conductor film 107*a*. The emitted electrons are attracted and converged to the data line (116*a*) to which voltage was applied. Thereby, the phosphor 117 can be made to emit light at a desired area thereof, and the display unit 114' is let to effect necessary display.

According to this structure, substantially the same advantage as with the 19th embodiment can be obtained. In addition, a diffusing electron beam can be converged by providing data lines on the display (114') side, and the light emission area can be effectively controlled.

Figure 44:
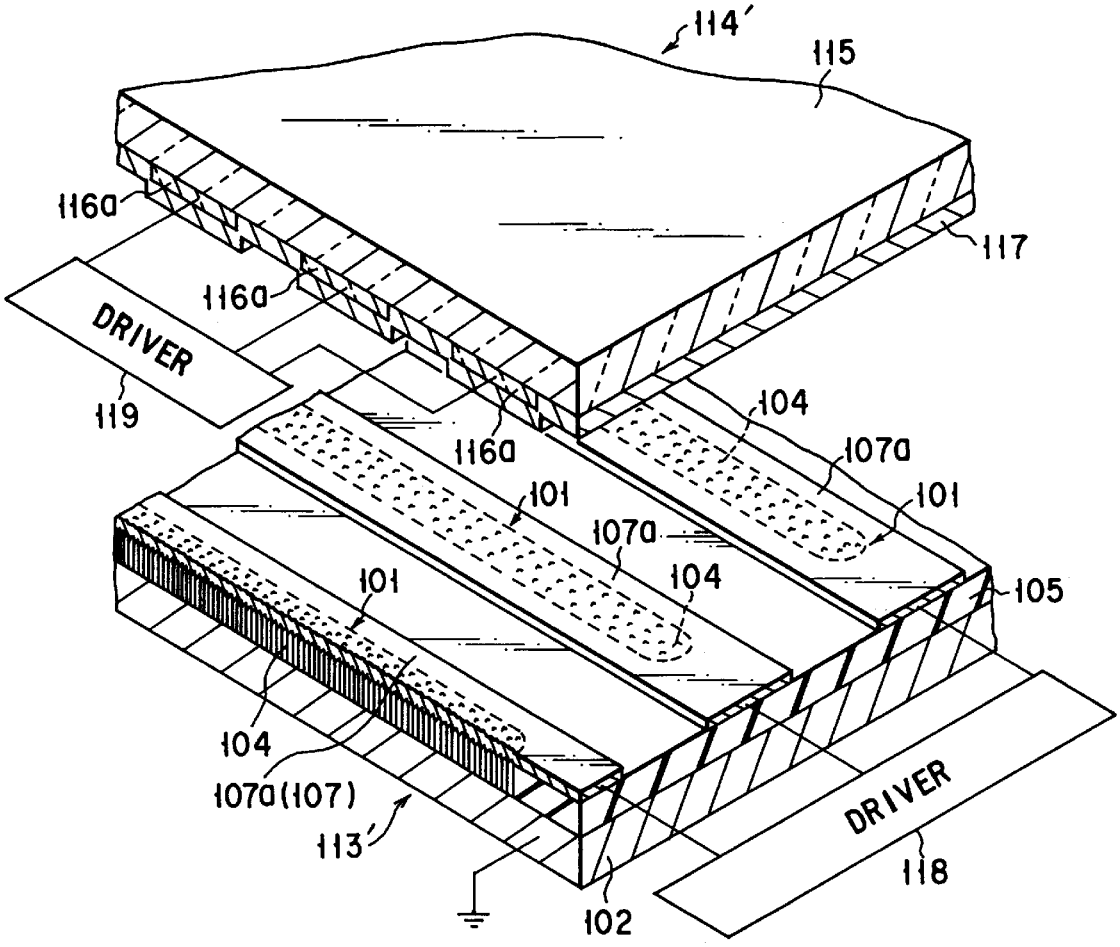
FIG. 44 is a perspective view showing a planar display device according to a 21st embodiment of the invention.

A planar display apparatus according to a 21st embodiment of the invention will now be described with reference to FIG. 44.

In the planar display apparatus of the 21st embodiment, like the planar display apparatus of the 20th embodiment, the electron emitting devices 101 of the first embodiment are used as electron emitting devices used as an electron emission source 113' and data lines are provided on the display (114') side.

However, in the electron emitting device 101 provided in the planar display apparatus 1, the through-hole formed in the insulating film 105 is not made circular, but is elongated, in the process of manufacturing the planar display apparatus according to the 20th embodiment. Thus, the electron emitting device 101 in this embodiment is formed linear along the address line (conductor film 107*a*), as shown in FIG. 44.

With this structure, too, substantially the same advantages as with the 20th embodiment can be obtained.

As has been described above, in the 17th to 21st embodiments, columnar crystal masses are used as emitter electrodes in MIM type (metal-insulator-metal) electron emitting device.

With the above structure, a planar electron beam emission source, which can be easily manufactured and has high electron emission efficiency, is provided. Thus, a planar display apparatus, which has high display quality and is operable at low operational voltage, can be constituted by integrating electron emitting devices.

Furthermore, according to the process of manufacturing the electron emitting device of the present invention, the above-mentioned emitter electrode can be formed by film formation techniques alone and at the same time the above-mentioned tip end portion of the emitter electrode can be sharpened. Accordingly, the electron emitting device with high electron emission efficiency can be easily manufactured.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. An electron emitting device comprising:

a conductor;

an emitter electrode for emitting electrons formed on the conductor, said emitter electrode including a mass of a plurality of columnar crystals each of said columnar crystals having a tip end portion for emitting electrons, wherein said plurality of columnar crystals are in physical contact with one another;

a gate electrode for extracting electrons from the tip end portion of each of the columnar crystals of said emitter electrode; and an electric potential source supplying a potential difference between said gate electrode and said conductor to apply an electric field to said plurality of columnar crystals.

2. The electron emitting device according to claim 1, wherein said tip end portion of each of the columnar crystals is sharpened.

3. The electron emitting device according to claim 1, wherein said columnar crystals are grown on said conductor by means of chemical vapor deposition including the reaction of $WF_6$ and $SiH_4$.

4. The electron emitting device according to claim 3, wherein each of said columnar crystals contains β-tungsten.

5. The electron emitting device according to claim 1, wherein said gate electrode has an edge portion applying the electric field to the columnar crystals via a gap between said edge portion and the columnar crystals.

6. The electron emitting device according to claim 5, wherein said gate electrode is laminated on the conductor with an insulating layer interposed between said gate electrode and said conductor.

7. The electron emitting device according to claim 5, wherein said gate electrode is laminated on the the columnar crystals with an insulating layer interposed between said gate electrode and said columnar crystals.

8. The electron emitting device according to claim 5, wherein said gate electrode has an open portion through which electrons are emitted from the tip end portion of each of the columnar crystals, said edge portion of the gate electrode comprising a peripheral portion of the open portion.

9. The electron emitting device according to claim 8, wherein said open portion has a round shape.

10. The electron emitting device according to claim 8, wherein said open portion has a slit shape.

11. The electron emitting device according to claim 8, wherein said columnar crystals are selectively formed on only a surface portion of the conductor corresponding to the open portion of the gate electrode.

12. The electron emitting device according to claim 8, wherein the levels of the tip end portions of the columnar crystals located at a central region of the open portion of the gate electrode are higher than the levels of the tip end portions of the columnar crystals outside the central region.

13. The electron emitting device according to claim 12, wherein the tip end portions of the columnar crystals located at the central region of the open portion of the gate electrode extend through the open portion of the gate electrode.

14. The electron emitting device according to claim 12, wherein a first portion of said conductor located at the central region of the open portion of the gate electrode is closer to the gate electrode than a second portion of said conductor surrounding said first portion of said conductor.

15. The electron emitting device according to claim 1, further comprising an anode electrode for receiving electrons emitted from the tip end portion of each of the columnar crystals of the emitter electrode.

16. The electron emitting device according to claim 15, wherein said anode electrode is provided with a phosphor, said phosphor emitting light upon receiving electrons emitted from the tip end portion of each of the columnar crystals.

17. An electron emission source comprising a plurality of said electron emitting devices according to claim 1.

18. The electron emission source according to claim 17, wherein said gate electrode is provided with a plurality of open portions, and wherein the electrons emitted from the tip end portions of at least some of the columnar crystals of the emitter electrode pass through each of said plurality of open portions.

19. The electron emission source according to claim 18, wherein each one of said open portions has a round shape.

20. The electron emission source according to claim 18, wherein each one of said open portions has a slit shape.

21. A planar display apparatus comprising:

an electron emission source having a plurality of said electron emitting devices according to claim 1; and a display unit emitting display light upon receiving electrons emitted from said electron emitting devices of said emission source.

22. The planar display apparatus according to claim 21, wherein said display unit further comprises:

a transparent plate member;

a transparent conductor film provided on a surface of said transparent plate member facing said electron emission source; and a phosphor for emitting light upon receiving electrons emitted from the electron emission source.

23. The planar display apparatus according to claim 22, wherein said display unit further comprises:

a third control line formed by dividing said transparent conductor film into a plurality of strips; and a control unit for controlling a voltage applied to said third control line, to control the range of light emission of said phosphor.

24. The planar display apparatus according to claim 21, wherein said electron emission source further comprises:

a first control line formed by dividing the conductor into a first plurality of strips;

a second control line formed by dividing the gate electrode into a second plurality of strips extending perpendicular to said first control line; and a control unit controlling a voltage applied to said first plurality of strips of said first control line and said second plurality of strips of said second control line to cause electrons to be emitted from the tip end portions of the columnar crystals of the emitter electrode provided at an intersection of a selected one of the first strips of said first control line and a selected one of the second strips of said second control line.

25. The planar display apparatus according to claim 21, wherein an insulating layer formed on the gate electrode is interposed between the electron emission source and the display unit.

26. An electron emitting device comprising:

a conductor;

an emitter electrode formed on the surface of the conductor and including a mass of a plurality of columnar crystals, each of said columnar crystals having a tip end portion for emitting electrons;

an insulating film formed on the mass of the columnar crystals and covering the tip end portion of each of the columnar crystals;

an electron extraction electrode formed on said insulating film for applying an electric field to said emitter electrode to extract electrons from the tip end portion of each of the columnar crystals; and wherein said plurality of columnar crystals are in physical contact with one another.

27. The electron emitting device according to claim 26, wherein said tip end portion of each of the columnar crystals is sharpened.

28. The electron emitting device according to claim 26, wherein said insulating film is formed on the surfaces of the tip end portions of the columnar crystals to a substantially uniform thickness, and said electron extraction electrode is formed on the surface of the insulating film to a substantially uniform thickness.

29. The electron emitting device according to claim 26, wherein said columnar crystals are grown on said conductor by means of chemical vapor deposition including the reaction of $WF_6$ and $SiH_4$.

30. The electron emitting device according to claim 29, wherein each of said columnar crystals contains β-tungsten.

31. The electron emitting device according to claim 30, further comprising:

an insulating layer formed on the surface of said conductor, said insulating layer having an opening through which a surface portion of said conductor is exposed; and said columnar crystals are formed on a surface portion of the conductor exposed by said opening.

32. The electron emitting device according to claim 26, further comprising an anode electrode receiving electrons emitted from the tip end portion of each of the columnar crystals of the emitter electrode.

33. The electron emitting device according to claim 32, wherein said anode electrode includes a phosphor emitting light upon receiving electrons emitted from the tip end portion of each of the columnar crystals.

34. An electron emission source comprising a plurality of said electron emitting devices according to claim 26.

35. A planar display apparatus comprising:

an electron emission source according to claim 34; and a display unit facing said electron emission source and emitting light for display upon receiving electrons emitted from said electron emission source.

36. The planar display apparatus according to claim 35, wherein said display unit further comprises:

a transparent plate member;

a transparent conductor film provided on a surface of said transparent plate member facing said electron emission source; and a phosphor for emitting light upon receiving electrons emitted from the electron emission source.

37. The planar display apparatus according to claim 36, wherein said display unit further comprises:

a third control line formed by dividing said transparent conductive film into a plurality of strips; and a control unit for controlling a voltage applied to said third control line to control the range of light emission of said phosphor.

38. The planar display apparatus according to claim 35, wherein said electron emission source further comprises:

a first control line formed by dividing the conductor into a plurality of first strips;

a second control line formed by dividing the gate electrode into a plurality of second strips extending perpendicular to said first strips of said first control line; and a control unit controlling a voltage applied to said first strips of said first control line and said second strips of said second control line to cause electrons to be emitted from the tip end portions of the columnar crystals provided at an intersection of a selected one of the first strips of said first control line and a selected one of the second strips of said second control line.

* * * * *